US009536682B2

(12) United States Patent
Kent et al.

(10) Patent No.: US 9,536,682 B2
(45) Date of Patent: Jan. 3, 2017

(54) DEVICES, SYSTEMS, METHODS, AND KITS FOR REMOTELY OPERATING A SWITCH

(71) Applicants: Jereme Kent, Findlay, OH (US); John Everett, Ann Arbor, MI (US); Chelsea Bumb, Carey, OH (US)

(72) Inventors: Jereme Kent, Findlay, OH (US); John Everett, Ann Arbor, MI (US); Chelsea Bumb, Carey, OH (US)

(73) Assignee: ONE ENERGY ENTERPRISES LLC, Findlay, OH (US)

( * ) Notice: Subject to any disclaimer, the term of this patent is extended or adjusted under 35 U.S.C. 154(b) by 124 days.

(21) Appl. No.: 14/630,068

(22) Filed: Feb. 24, 2015

(65) Prior Publication Data

US 2015/0348717 A1 Dec. 3, 2015

Related U.S. Application Data

(60) Provisional application No. 61/997,280, filed on May 27, 2014.

(51) Int. Cl.

| | |
|---|---|
| ***H01H 3/20*** | (2006.01) |
| ***H01H 3/02*** | (2006.01) |
| ***H01H 11/00*** | (2006.01) |
| ***H01H 17/26*** | (2006.01) |
| ***H01H 17/30*** | (2006.01) |

(52) U.S. Cl.

CPC ..... *H01H 3/02* (2013.01); *H01H 3/0226* (2013.01); *H01H 11/00* (2013.01); *H01H 17/26* (2013.01); *H01H 17/30* (2013.01); *H01H 3/20* (2013.01); *Y10T 29/49718* (2015.01)

(58) Field of Classification Search

CPC ..... H01H 3/0226; H01H 17/08; H01H 17/30; H01H 17/26; H01H 3/20

USPC ..... 200/413, 418, 543, 330, 331

See application file for complete search history.

(56) References Cited

U.S. PATENT DOCUMENTS

| | | | | |
|---|---|---|---|---|
| 1,365,722 | A * | 1/1921 | Papini | H01R 33/9555 200/331 |
| 1,458,864 | A * | 6/1923 | Upton | F21V 23/04 200/331 |
| 1,488,279 | A * | 3/1924 | Owens | F21V 23/04 200/331 |
| 3,235,696 | A | 2/1966 | Mikulecky | |
| 3,534,993 | A | 10/1970 | Le Vesque, Sr. | |
| 3,627,367 | A | 12/1971 | Levy | |

(Continued)

OTHER PUBLICATIONS

Moloney Electric, "3-Phase Padmounted Transformers," www.moloneytx.com, 2009, pp. 1-4.

(Continued)

*Primary Examiner* — Felix O Figueroa
(74) *Attorney, Agent, or Firm* — Buchanan Nipper

(57) ABSTRACT

Devices, systems, methods, and kits for remotely operating a switch are described herein. An example embodiment of a system for remotely operating a switch comprises a plate, a connecting member, a first fastener, a second fastener, a first attachment member, a second attachment member, a first wire member, a second wire member, and a pulling member. The plate has a body that defines a first bend and a second bend and is releasably attached to the handle of a switch. During use, an operator utilizes the first and second wire members to moved the switch between an open state and a closed state.

20 Claims, 11 Drawing Sheets

(56) References Cited

U.S. PATENT DOCUMENTS

| | | | | |
|---|---|---|---|---|
| 3,739,452 | A | 6/1973 | Gadberry | |
| 3,810,060 | A | 5/1974 | Hubbard | |
| 3,827,039 | A * | 7/1974 | Agnese | G08B 17/02 200/331 |
| 4,221,946 | A * | 9/1980 | Halstrum | H01H 15/10 200/331 |
| 4,745,243 | A * | 5/1988 | Wang | H01H 17/08 200/330 |
| 5,934,139 | A | 8/1999 | Tucker | |
| 6,531,841 | B1 | 3/2003 | Elli et al. | |
| 6,922,888 | B2 | 8/2005 | Barry et al. | |
| 7,920,037 | B2 | 4/2011 | Lindsey et al. | |
| 2002/0177352 | A1 | 11/2002 | Barry et al. | |

OTHER PUBLICATIONS

ERMCO, "Instruction Manual #103: Three Phase Pad Mount Distribution Transformer," www.ermco-eci.com, Mar. 2014, pp. 1-5.
ERMCO, "Cover Removal Instructions," Jan. 25, 2010, pp. 1-4.
Cooper Power Systems, "Functional Specification for Three-Phase Pad-Mounted Distribution Transformers 45-10,000 kVA," Distribution Transformers, Eaton, Aug. 2013, pp. 1-14.
Howard Industries, "Instructions (HI-105)," Distribution Transformer Division, Mar. 2012, pp. 1-36.
Eaton, "Pad-Mounted Transformers," www.eaton.com/consultants, Sep. 2011, pp. 1-14.
Cooper Power Systems, "Electrical Distribution Products for Commercial and Industrial Applications," www.cooperpower.com, Aug. 2005, pp. 1-20.
Cooper Power Systems, "Three-phase pad-mounted compartmental type transformer," Eaton, Aug. 2013, pp. 1-12.
Cooper Power Systems, "Three-phase pad-mounted compartmental type installation and maintenance instructions," Eaton, Aug. 2013, pp. 1-32.
Cooper Power Systems, "Two-Position Sidewall (Horizontal) and Cover (Vertical) Mounted Loadbreak Switches," OEM Equipment, Aug. 2012, pp. 1-8.
Cooper Power Systems, "External visible loadbreak option," Eaton, 2013, pp. 1-2.
Headlines@Hopkins, "Students' Device Aims to Protect Electric Utility Workers," News Release, Johns Hopkins University News Releases, accessed Nov. 5, 2014, pp. 1-4.
Advance Controls, Inc., Safety Switches—Top Entrance Rope Pull, ACIcontrols.com, accessed Nov. 4, 2014, pp. 1-2, http://www.acicontrols.com/catalog/product_detail.cfm/ID/255/Top-Entrance-Rope-Operated-Metal-Housing-Ordering-Info/.

* cited by examiner

DEVICES, SYSTEMS, METHODS, AND KITS FOR REMOTELY OPERATING A SWITCH

RELATED APPLICATION

This application claims the benefit of U.S. Provisional Application No. 61/977,280, filed May 27, 2014. The disclosure of this related application is hereby incorporated into this disclosure in its entirety.

FIELD

The disclosure relates generally to the field of switches and their operation.

BACKGROUND

A variety of electrical switches have been developed that provide a mechanism to alter the state of an electrical device, such as a transformer. For example, a loadbreak switch can be used to energize and de-energize a transformer by moving the loadbreak switch between an open state and a closed state. The art provides examples of devices and methods for manipulating a loadbreak switch in this manner. Unfortunately, known devices and methods have multiple drawbacks, including some that present significant safety concerns. For example, conventional telescoping hot sticks—an elongated rod designed to allow an operator to manipulate the handle of a loadbreak switch from a distance—are heavy and can be difficult to engage with a target handle. Furthermore, these devices require the operator to take a position directly in front of the electrical device controlled by the switch, such as a transformer, potentially exposing the operator to an arc flash or other dangerous conditions that can develop as a result of manipulating the switch.

A need exists, therefore, for improved devices, systems, methods, and kits for remotely operating a switch.

BRIEF SUMMARY OF SELECTED EXAMPLE EMBODIMENTS

An example embodiment of a device for remotely operating a switch comprises a plate, a connecting member, a first fastener, and a second fastener. The plate has a first end, a second end, a first end portion, an intermediate portion, a second end portion, and a body. The body of the plate defines a first bend, a second bend, a first passageway, a second passageway, a third passageway, and a fourth passageway. The first end portion extends from the first end to the intermediate portion. The intermediate portion extends from the first end portion to the second end portion. The second end portion extends from the intermediate portion to the second end. The first bend is defined between the first passageway and the second passageway such that the first end portion extends from the first bend in a first direction. The second bend is defined between the third passageway and the fourth passageway such that the second end portion extends from the second bend in a second direction that is substantially opposite the first direction. The first passageway is defined on the first end portion and the fourth passageway is defined on the second end portion. The connecting member is releasably attached to the plate and has a first end, a second end, and a body that defines a first passageway and a second passageway. The first fastener is adapted to provide releasable attachment between the plate, the connecting member, and the switch. The first fastener is partially disposed within the second passageway defined by the plate and the first passageway defined by the connecting member. The second fastener is adapted to provide releasable attachment between the plate, the connecting member, and the switch. The second fastener is partially disposed within the third passageway defined by the plate and the second passageway defined by the connecting member.

An example embodiment of a system for remotely operating a switch comprises a device for remotely operating a switch, an exterior housing, an elastic member, a first wire member, a second wire member, a first indicator, a second indicator, and a pulling member. The system is disposed within a cabinet that houses a transformer and a switch. The cabinet comprises a body, a first door, and a second door. The body of the cabinet, the first door, and the second door cooperatively define a chamber that houses the transformer and the switch. The body of the cabinet defines a passageway that provides access between the chamber defined by the cabinet and an environment exterior to the body of the cabinet. The exterior housing has a body and a cover that is hingedly attached to the body of the exterior housing. The exterior housing is attached to the cabinet such that it is in communication with the passageway defined by the body of the cabinet. The elastic member is attached to an interior surface of the body of the cabinet such that it is disposed within the chamber defined by the cabinet. The elastic member is disposed between the device for remotely operating a switch and the passageway defined by the body of the cabinet. The elastic member defines a passageway that is sized and configured to receive a portion of the first wire member and a portion of the second wire. The first wire member has a first end, a second end, and a length that extends from the first end of the first wire member to the second end of the first wire member. The first end of the first wire member is attached to the device for remotely operating a switch. The second wire member has a first end, a second end, and a length that extends from the first end of the second wire member to the second end of the second wire member. The first end of the second wire member is attached to the device for remotely operating a switch. The first indicator is attached to the second end of the first wire member and comprises a body that has one or more indicia. The second indicator is attached to the second end of the second wire member and comprises a body that has one or more indicia. The pulling member has a first end, a second end, and a hook that is attached to the first end of the pulling member. The pulling member is configured to be attached to at least one of the first wire member or the second wire member.

An example method of retrofitting a handle of a switch with a device for remotely operating a switch comprises the steps of: obtaining a device for remotely operating a switch, the device comprises a plate, a connecting member, a first fastener, and a second fastener; positioning the plate on a first side of a handle of a switch; positioning the connecting member on a second side of the handle of the switch; passing the first fastener through the plate and the connecting member; securing the first fastener to the plate and the connecting member; passing the second fastener through the plate, the handle of switch, and the connecting member; and securing the second fastener to the plate and connecting member.

An example method of attaching a system for remotely operating a switch to a cabinet and a handle of a switch comprises the steps of: obtaining a system for remotely operating a switch, the system comprises a device for remotely operating a switch, an exterior housing, an elastic member, a first wire member, a second wire member, a first indicator, a second indicator, and a pulling member; attaching the device for remotely operating a switch to the handle of the switch; attaching the first wire member to the device for remotely operating a switch; attaching the second wire member to the device for remotely operating a switch; attaching the elastic member to the cabinet, the elastic member defining a passageway; attaching the exterior housing to the body of the cabinet such that it is in communication with a passageway defined by the body of the cabinet; passing the first wire member through the passageway defined by the elastic member; passing the first wire member through the passageway defined by the housing of the cabinet and into exterior housing; passing the second wire member through the passageway defined by the elastic member; and passing the second wire member through the passageway defined by the housing of the cabinet and into exterior housing.

An example method of remotely operating a switch to perform work comprises the steps of: identifying a cabinet that houses a handle of a switch and a system for remotely operating a switch, the system comprises a device for remotely operating a switch that is attached to the handle of the switch, an exterior housing, an elastic member, a first wire member, a second wire member, a first indicator, a second indicator, and a pulling member; opening the exterior housing; opening the cabinet; determining the current position of the handle of the switch; determining whether manipulation of the handle is required; determining which wire member will achieve the desired manipulation of the handle; attaching the pulling member to the second end of the wire member that will achieve the desired manipulation of the handle; applying an axial force away from the handle on the pulling member until the handle moves from its current position to an altered position; determining whether the handle has been moved to the altered position; performing work; removing the pulling member from the second end of the wire member to which the pulling member is attached; determining whether manipulation of the handle is required; determining which wire member will achieve the desired manipulation of the handle; attaching the pulling member to the second end of the wire member that will achieve the desired manipulation of the handle; applying an axial force away from the handle on the pulling member until the handle moves from its current position to an altered position; removing the pulling member from the wire member to which it is attached; closing the exterior housing; and closing the cabinet.

An example embodiment of a kit for remotely operating a switch comprises a device for remotely operating a switch, a first wire member, a second wire member, a first indicator, a second indicator, an exterior housing, and a pulling member. The device for remotely operating the switch comprises a plate, a connecting member, a first fastener, and a second fastener. The first wire member is adapted to be attached to the plate and is moveable between a first position and a second position when it is attached to the plate. The second wire member is adapted to be attached to the plate and is moveable between a first position and a second position when it is attached to the plate. The first indicator comprises one or more indicia that correspond to the state of the switch when the first wire member is attached to the plate and is in the second position. The second indicator comprises one or more indicia that correspond to the state of the switch when the second wire member is attached to the plate and is in the second position. The exterior housing has a body and a cover and is sized and configured to house a portion of the first wire member, the second wire member, the first indicator, and the second indicator. The pulling member is adapted to be attached to at least one of the first wire member or the second wire member.

DETAILED DESCRIPTION

The following detailed description and the appended drawings describe and illustrate various example embodiments of devices, systems, methods, and kits for remotely operating a switch. The description and illustration of these examples are provided to enable one skilled in the art to make and use a device for remotely operating a switch, a system for remotely operating a switch, a kit that includes a device for remotely operating a switch, to practice a method of retrofitting a handle of a switch with a device for remotely operating a switch, to practice a method of attaching a system for remotely operating a switch to the handle of a switch and a cabinet, and to practice a method of remotely operating a switch to perform work. They are not intended to limit the scope of the claims in any manner.

The use of "e.g.," "etc.," "for instance," "in example," and "or," and grammatically related terms, indicates non-exclusive alternatives without limitation, unless otherwise noted. The use of "attached," and grammatically related terms, refers to the fixed, releasable, or integrated association of two or more elements and/or devices, unless otherwise noted.

Figure 1:
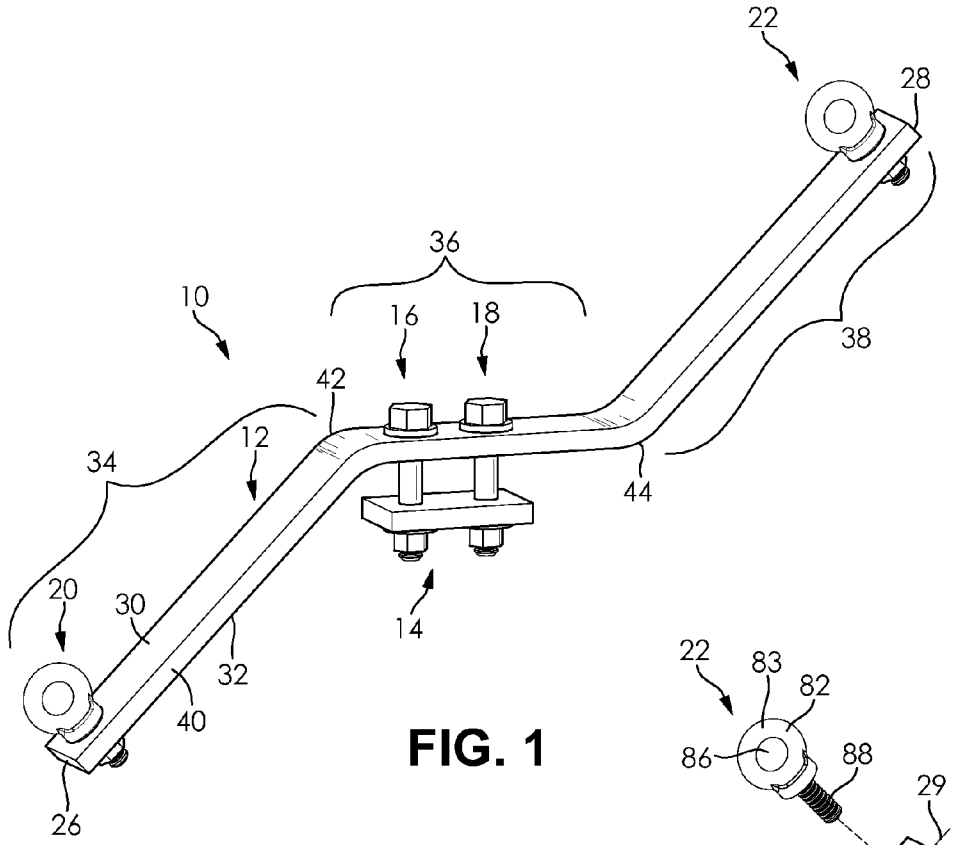
FIG. 1 is a perspective view of an example embodiment of a device for remotely operating a switch.
Figure 2:
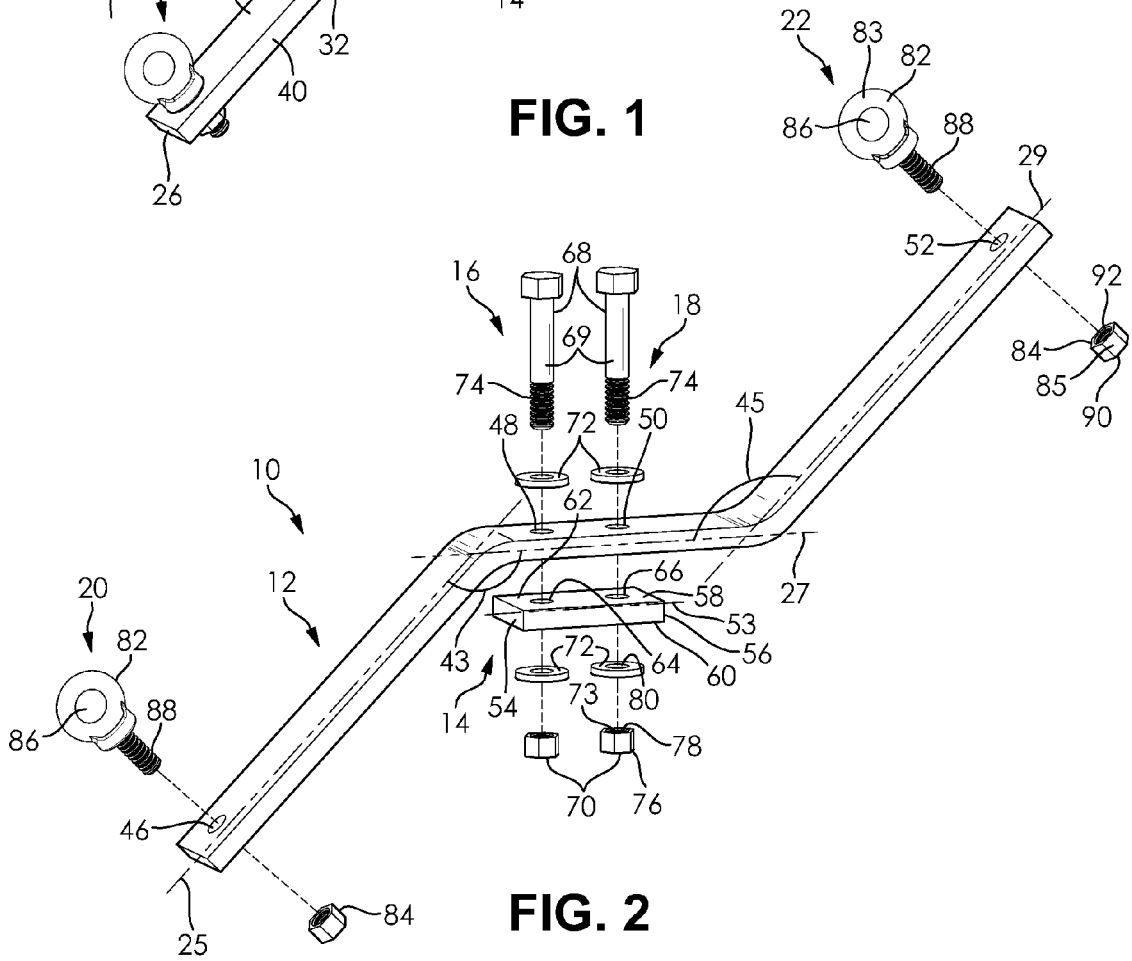
FIG. 2 is an exploded view of the device illustrated in FIG. 1.

FIGS. 1 and 2 illustrate an example embodiment of a device 10 useful for remotely operating a switch. The device 10 includes a plate 12, a connecting member 14, a first fastener 16, a second fastener 18, a first attachment member 20, and a second attachment member 22.

In the illustrated embodiment, the plate 12 has a first end 26, a second end 28, a first side 30, a second side 32, a first end portion 34, an intermediate portion 36, a second end portion 38, and a body 40. The body 40 defines a first bend 42, a second bend 44, a first passageway 46, a second passageway 48, a third passageway 50, and a fourth passageway 52. The first end portion 34 has a lengthwise axis 25, the intermediate portion 36 has a lengthwise axis 27, and the second end portion 38 has a lengthwise axis 29.

The first end portion 34 has a first length that extends from the first end 26 to the intermediate portion 36. The intermediate portion 36 has a second length that extends from the first end portion 34 to the second end portion 38. The second end portion 38 has a third length that extends from the intermediate portion 36 to the second end 28. In the illustrated embodiment, the first length and the third length are equal. In addition, the first length is greater than the second length. While the first length is illustrated as being equal to the third length and greater than the second length, a plate can include a first end portion that has any length considered suitable for a particular embodiment. Example lengths considered suitable for the first end portion of a plate include lengths that are greater than, equal to, substantially equal to, or less than the length of an intermediate portion and/or a second end portion. A first end portion, intermediate portion, and/or second end portion can have any suitable length that forms a device for remotely operating a switch capable of providing sufficient leverage to operate the component or feature to which the device for remotely operating a switch is intended to be attached and/or capable of avoiding contact with other devices, components, or features during use (e.g., devices positioned relative to the component or feature to which the device for remotely operating a switch is intended to be attached).

The body 40 defines the first bend 42 between the first end portion 34 and the intermediate portion 36 and between the first passageway 46 and the second passageway 48. The first bend 42 is defined at a first angle 43 such that the first end portion 34 extends in a first direction from the first bend 42. The body 40 defines the second bend 44 between the intermediate portion 36 and the second end portion 38 and between the third passageway 50 and the fourth passageway 52. The second bend 44 is defined at a second angle 45 such that the second end portion 38 extends in a second direction from the second bend 44 that is substantially opposite the first direction. The first angle 43 is measured from the lengthwise axis 25 of the first end portion 34 to the lengthwise axis 27 of the intermediate portion 36. The second angle 45 is measured from the lengthwise axis 27 of the intermediate portion 36 to the lengthwise axis 29 of the second end portion 38. In the illustrated embodiment, each of the first angle 43 and the second angle 45 is equal to 135 degrees. However, alternative embodiments can include a plate that has a body that defines a first angle that is greater than, equal to, substantially equal to, or less than a second angle. For example, a plate can have a body that defines a first angle that is different than a second angle.

While the first angle 43 and the second angle 45 are illustrated as being equal to 135 degrees and are defined such that the first end portion 34 and the second end portion 38 extend in substantially opposite directions, a plate of a device for remotely operating a switch can define a first bend and/or a second bend at any angle considered suitable for a particular embodiment. Example angles considered suitable to define a first bend and/or a second bend include angles between 1 degree and 180 degrees, angles between about 1 degree and about 180 degrees, acute angles, obtuse angles, angles that position a first end portion and a second end portion such that they extend in opposite directions, and any other angle considered suitable for a particular embodiment. A first bend and/or second bend can be defined at any suitable angle that forms a device for remotely operating a switch capable of providing sufficient leverage to operate the component or feature to which the device for remotely operating a switch is intended to be attached and/or capable of avoiding contact with other devices, components, or features during use (e.g., devices positioned relative to the component or feature to which the device for remotely operating a switch is intended to be attached).

While the first bend 42 is illustrated as being defined between the first end portion 34 and the intermediate portion 36 and the second bend 44 is illustrated as being defined between the intermediate portion 36 and the second end portion 38, a bend can be defined at any suitable location on a plate according to a particular embodiment. Example locations considered suitable to define a bend include defining a bend on a first end portion, between a first end portion and an intermediate portion, on an intermediate portion, between an intermediate portion and a second end portion, and/or on a second end portion. While plate 12 is illustrated as having two bends 42, 44, the body of a plate can define any suitable number of bends. Example number of bends considered suitable for the body of a plate to define include one, at least one, two, a plurality, three, four, and any other number considered suitable for a particular embodiment. The number of bends, and the angle of each bend, included on a plate will vary depending on the structural arrangement of the component or feature to which a device for remotely operating a switch is intended to be attached.

The body 40 defines the first passageway 46 on the first end portion 34, the second passageway 48 and the third passageway 50 on the intermediate portion 36, and the fourth passageway 52 on the second end portion 38. Each of the first passageway 46, the second passageway 48, the third passageway 50, and the fourth passageway 52 extends from the first side 30 to the second side 32 and is sized and configured to receive a fastener or an attachment member. The first passageway 46 is defined near the first end 26 of the plate 12 and on a quarter of the length of the first end portion 34 that extends from the first end 26 toward the intermediate portion 36. The second passageway 48 is defined between the first passageway 46 and the third passageway 50. The third passageway 50 is defined at the center of the intermediate portion 36 and between the second passageway 48 and the fourth passageway 52. In the illustrated embodiment, the third passageway 50 is disposed at the center of the plate 12. The fourth passageway 52 is disposed near the second end 28 of the plate 12 and on a quarter of the length of the second end portion 38 that extends from the second end 28 toward the intermediate portion 36.

In the illustrated embodiment, the first passageway 46 is defined on a first axis and the fourth passageway 52 is defined on a second axis that is parallel with the first axis. The second passageway 48 is defined on a third axis and the third passageway 50 is defined on a fourth axis that is parallel to the third axis. Each of the third axis and fourth axis is orthogonal to a plane that contains the lengthwise axis 27 of the intermediate portion 36. However, alternative embodiments can include a first passageway that is defined on a first axis and a fourth passageway that is defined on a second axis that is not parallel to the first axis and/or a second passageway that is defined on a third axis and a third passageway that is defined on a fourth axis that is not parallel with the third axis.

While the first passageway 46, the second passageway 48, the third passageway 50, and the fourth passageway 52 are illustrated as being defined at particular locations on the plate 12 and as having a particular structural configuration, a passageway can be located at any suitable location on a plate and have any suitable structural configuration. Example locations considered suitable to define a passageway on a plate include defining a passageway at the center of the first end portion, at the first end, near the first end, on a quarter of the length of the first end portion that extends from the first end toward the intermediate portion, on a half of the length of the first end portion that extends from the first end toward the intermediate portion, at the center of the intermediate portion, at the first end of the intermediate portion, at the second end of the intermediate portion, near the first end of the intermediate portion, near the second end of the intermediates portion, on a quarter of the length of the intermediate portion that extends from the first end portion toward the second end portion, on a half of the length of the intermediate portion that extends from the first end portion toward the second end portion, on a quarter of the length of the intermediate portion that extends from the second end portion toward the first end portion, on a half of the length of the intermediate portion that extends from the second end portion toward the first end portion, at the center of the second end portion, at the second end, near the second end, on a quarter of the length of the second end portion that extends from the second end toward the intermediate portion, on a half of the length of the second end portion that extends from the second end toward the intermediate portion, or at any location considered suitable for a particular embodiment. Alternative embodiments can include one or more passageways, such as those illustrated in FIGS. 1 and 2, that define internal threads that are sized and configured to mate with external threads of a fastener or attachment member, as described in more detail herein.

While plate 12 is illustrated as having four passageways 46, 48, 50, and 52, the body of a plate can define any suitable number of passageways. Example number of passageways considered suitable for the body of a plate to define include one, at least one, two, a plurality, three, four, five, six, and any other number considered suitable for a particular embodiment. For example, one or more of the passageways illustrated in FIGS. 1 and 2 can be omitted (e.g., second passageway 48). The number of passageways defined by the body of a plate will vary depending on the structural arrangement of the component or feature to which a device for remotely operating a switch is intended to be attached.

While the plate 12 is illustrated as having a particular structural configuration, a plate included in a device for remotely operating a switch can have any suitable shape, size, and configuration, and the illustrated plate is merely an example of a suitable plate. For example, a plate can be formed such that it defines more than two bends and/or defines more than four passageways.

In the illustrated embodiment, the connecting member 14 has a lengthwise axis 53, a first end 54, a second end 56, a first side 58, a second side 60, and a body 62. The body 62 defines a first passageway 64 and a second passageway 66. The connecting member 14 has a length that extends from the first end 54 to the second end 56. The length of the connecting member 14 is equal to the length of the intermediate portion 36 of the plate 12. While the length of the connecting member 14 is illustrated as being equal to the length of the intermediate portion 36, a connecting member can have any length considered suitable for a particular embodiment. Example lengths considered suitable for a connecting member include lengths that are equal to, substantially equal to, greater than, or less than the length of the intermediate portion of a plate.

The body 62 of the connecting member 14 defines the first passageway 64 between the first end 54 and the second passageway 66 and the second passageway 66 between the first passageway 64 and the second end 56. Each of the first passageway 64 and the second passageway 66 extends from the first side 58 to the second side 60 and is sized and configured to receive a fastener 16, 18. In the illustrated embodiment, the distance between the second passageway 48 and third passageway 50 defined by the plate 12 is equal to the distance between the first passageway 64 and the second passageway 66 defined by the connecting member 14.

While connecting member 14 is illustrated as having two passageways 64, 66, the body of a connecting member can define any suitable number of passageways. Example number of passageways considered suitable for the body of a connecting member to define include one, at least one, two, a plurality, three, four, five, six, and any other number considered suitable for a particular embodiment. For example, one of the passageways illustrated in FIGS. 1 and 2 can optionally be omitted (e.g., first passageway 64). The number of passageways defined by the body of a connecting member will vary depending on the structural arrangement of the plate to which the connecting member is intended to be attached.

In the illustrated embodiment, the plate 12 is formed of a first material and the connecting member 14 is formed of a second material. The first material is the same as the second material. Any suitable material can be used to form a plate and/or a connecting member in a device for remotely operating a switch according to a particular embodiment. Examples of materials considered suitable to form a plate and/or connecting member include metals, steel, aluminum, rigid materials, non-conductive materials, plastics, rigid plastics, fiberglass, graphite, and any other materials considered suitable for a particular embodiment. In alternative embodiments, a plate can be formed of a first material and a connecting member can be formed of a second material that is different than the first material.

While the connecting member 14 is illustrated as having a particular structural configuration, a connecting member included in a device for remotely operating a switch can have any suitable shape, size, and configuration, and the illustrated connecting member is merely an example of a suitable connecting member. For example, a connecting member can be formed such that it defines one or more bends and/or defines one passageway or more than two passageways. Alternative embodiments can include a connecting member that is an integrated component of a plate. For example, a connecting member, such as those described herein, can be directly attached to a plate such that it forms a portion of the plate.

Figure 2A:
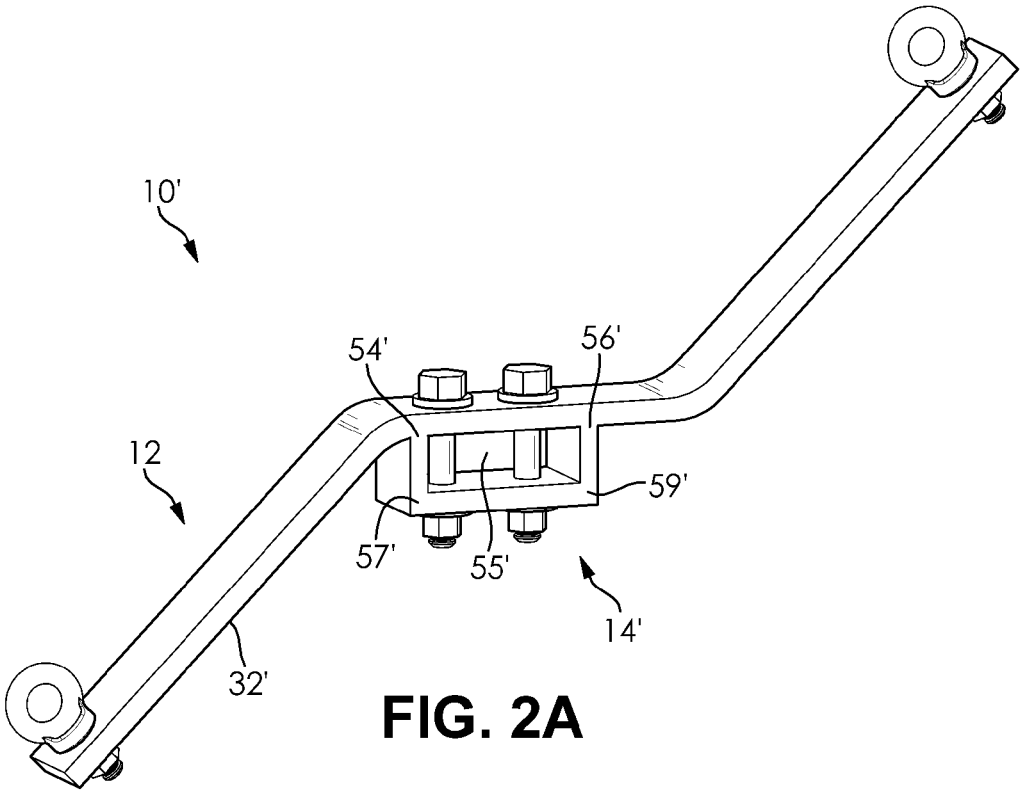
FIG. 2A is a perspective of the device illustrated in FIGS. 1 and 2 with an alternative plate and connecting member.

An example embodiment that includes a connecting member directly attached to a plate is illustrated in FIG. 2A. The plate 12' and connecting member 14' are similar to the plate 12 and connecting member 14 illustrated in FIGS. 1 and 2 and described herein, except as described. With respect to plate 12' and connecting member 14', reference numbers in FIG. 2A refer to the same structural element or feature referenced by the same number in FIGS. 1 and 2, offset by '. In the illustrated embodiment, each of the first end 54' and second end 56' of the connecting member 14' is directly attached to the second side 32' of the plate 12' such that the plate 12' and connecting member 14' cooperatively define a passageway 55'. Alternatively, one of the first end or the second end of a connecting member can be attached to a plate. The passageway 55' is sized and configured to receive a portion of a component or feature to which the device for remotely operating a switch is intended to be attached (e.g., handle of a switch). The first end 54' and the second end 56' can be attached to the plate 12' using any suitable structure or method of attachment. Example structures or methods of attachment considered suitable to attach a connecting member to a plate include welding, fusing, using adhesives, snap-fit fasteners, threaded members, such as bolts, screws, nuts, wingnuts, and any other structure or method of attachment considered suitable for a particular embodiment. In the illustrated embodiment, the connecting member 14' is welded to the plate 12'.

The connecting member 14' defines a first bend 57' and a second bend 59' between the first end 54' and the second end 56' of the connecting member 14'. Each of the first bend 57' and the second bend 59' is defined at a 90 degree angle relative to the intermediate portion of the connecting member 14'. While the connecting member 14' has been illustrated as defining a first bend 57' and a second bend 59' at a 90 degree angle relative to the intermediate portion of the connecting member 14', a connecting member can define any suitable number of bends at any suitable angle relative to an intermediate portion of a connecting member. Example number of bends considered suitable to define on a connecting member include one, at least one, two, a plurality, three, four, and any other number considered suitable for a particular embodiment. Example angles considered suitable to define a bend relative to the intermediate portion of a connecting member include angles between 1 degree and 180 degrees, angles between about 1 degree and about 180 degrees, angles between 45 degrees and 135 degrees, angles between about 45 degrees and about 135 degrees, acute angles, obtuse angles, and any other angle considered suitable for a particular embodiment.

Each of the first fastener 16 and second fastener 18 is adapted to provide releasable attachment between the plate 12, the connecting member 14, and/or the feature or component that the device 10 for remotely operating a switch is intended to be attached. Any suitable fastener capable of providing releasable attachment between a plate, a connecting member, and another feature or component can be included in the devices described herein. Example fasteners considered suitable to include in a device for remotely operating a switch include snap-fit fasteners, clevis pins, cotter pins, threaded members, such as bolts, U-bolts, screws, nuts, wingnuts, clamps, and any other fastener considered suitable for a particular embodiment.

As shown in FIGS. 1 and 2, an example of a suitable first fastener 16 and a suitable second fastener 18 is a bolt 68, a nut 70, and a plurality of washers 72. Each bolt 68 has a body 69 that defines external threads 74 along a portion of its length. Each nut 70 has a body 73 that defines a passageway 76 that has internal threads 78. A portion of each bolt 68 is sized and configured to be received by the passageway 76 defined by a nut 70 such that the external threads 74 of the bolt 68 mate with the internal threads 78 of the nut 70. Each washer of the plurality of washers 72 defines a passageway 80 that is sized and configured to receive a portion of a bolt 68.

While device 10 is illustrated as including two fasteners 16, 18, a device for remotely operating a switch can include any suitable number of fasteners. Example number of fasteners considered suitable to include in a device for remotely operating a switch include one, at least one, two, a plurality, three, four, and any other number considered suitable for a particular embodiment. The number of fasteners included with a device for remotely operating a switch will depend on the number of passageways defined by a plate, the number of passageways defined by a connecting member, and/or the structural configuration of the component or feature to which the device for remotely operating a switch is intended to be attached. While the first fastener 16 is illustrated as being the same as the second fastener 18, a first fastener included in a device for remotely operating a switch can be different than a second fastener included in the device.

While the bolts 68, nuts 70, and washers 72 are illustrated as having a particular structural arrangement, a bolt, nut, and/or washer included in a device for remotely operating a switch can have any suitable shape, size, and configuration. The shape, size, and configuration of a fastener included with a device for remotely operating a switch will depend on various considerations, such as the thickness of a plate and/or a connecting member, the configuration of the passageways defined by a plate and/or a connecting member, and/or the structural configuration of the component or feature to which the device for remotely operating a switch is intended to be attached. Alternative embodiments of a fastener can omit the inclusion of a nut and/or washers. For example, if a plate and/or a connecting member has a body that defines one or more passageways with internal threads, the fastener (e.g., bolt) included in a device for remotely operating a switch can define external threads that are sized and configured to mate with the internal threads defined by the plate and/or connecting member such that the fastener can be releasably attached to the plate and/or connecting member.

Each of the first attachment member 20 and second attachment member 22 provides a mechanism to attach another component, such as a wire member, to the plate 12. Any suitable attachment member capable of providing attachment between another component and a plate can be included in the devices described herein. Example attachment members considered suitable to include in a device for remotely operating a switch include threaded members, such as eye bolts, nuts, wingnuts, and any other attachment member considered suitable for a particular embodiment.

As shown in FIGS. 1 and 2, an example of a suitable first attachment member 20 and a suitable second attachment member 22 is an eye bolt 82 and a nut 84. Each eye bolt 82 has a body 83 that defines a passageway 86 and external threads 88 along a portion of the length of the eye bolt 82. Each nut 84 has a body 85 that defines a passageway 90 and internal threads 92. A portion of the eye bolt 82 is sized and configured to be received by the passageway 90 defined by the nut 84 such that the external threads 88 of the eye bolt 82 mate with the internal threads 92 of the nut 84.

While device 10 is illustrated as including two attachment members 20, 22, a device for remotely operating a switch can include any suitable number of attachment members. Example number of attachment members considered suitable to include with a device for remotely operating a switch include one, at least one, two, a plurality, three, four, and any other number considered suitable for a particular embodiment. The number and type of attachment members included with a device for remotely operating a switch will depend on the number of passageways defined by the plate and/or the structural configuration of the component or feature intended to be attached to the attachment member. While the first attachment member 20 is illustrated as being the same as the second attachment member 22, a first attachment member included in a device for remotely operating a switch can be different than a second attachment member included in the device. Alternative embodiments can omit the inclusion of an attachment member such that another component (e.g., wire member) can be directly attached to a plate included in a device for remotely operating a switch. For example, another component can be directly attached to a plate using a passageway defined by a plate.

While the eye bolts 82 and nuts 84 are illustrated as having a particular structural arrangement, a bolt, and/or nut included in a device for remotely operating a switch can have any suitable shape, size, and configuration. The shape, size, and configuration of an attachment member included with a device for remotely operating a switch will depend on various considerations, such as the thickness of a plate and/or connecting member, the structural configuration of the passageways defined by a plate and/or connecting member, and/or the structural configuration of the component or feature to which the device for remotely operating a switch is intended to be attached. Alternative embodiments of an attachment member can omit the inclusion of a nut. For example, if a plate has a body that defines one or more passageways that have internal threads, the attachment member (e.g., eye bolt) included in a device for remotely operating a switch can define external threads that are sized and configured to mate with the internal threads defined by the plate such that the attachment member can be releasably attached to the plate.

To releasably attach the connecting member 14 to the plate 12, a bolt 68 is passed through the passageway 80 of a washer of the plurality of washers 72, then through a passageway defined by the plate 12 (e.g., second passageway 48, third passageway 50), then through a passageway defined by the connecting member 14 (e.g., first passageway 64, second passageway 66), then through a passageway 80 defined by a second washer of the plurality of washers 72, and then is threaded with a nut 70. Depending on the structural arrangement of the component or feature to which the device 10 is being attached, the nut 70 can be adjusted along the external threads 74 of the bolt 68 to achieve a fixed attachment between the plate 12, connecting member 14, and the component or feature to which these elements are being attached.

To releasably attach an attachment member 20, 22 to the plate 12, an eye bolt 82 is passed through a passageway defined by the plate 12 (e.g., first passageway 46, fourth passageway 52) and then is threaded with a nut 84. Depending on the structural arrangement of a plate (e.g., thickness of plate 12) to which the eye bolt 82 and nut 84 are being attached, the nut 84 can be adjusted along the external threads 88 of the eye bolt 82 to achieve a fixed attachment between the attachment member and the plate 12.

Each component of the first fastener 16, the second fastener 18, the first attachment member 20, and/or the second attachment member 22 can be formed of any suitable material. In the illustrated embodiment, each component of the first fastener 16, the second fastener 18, the first attachment member 20, and the second attachment member 22 is formed of the same material. Any suitable material can be used to form a first fastener, a second fastener, a first attachment member, and/or a second attachment member in a device according to a particular embodiment. Examples of materials considered suitable to form a first fastener, a second fastener, a first attachment member, and/or a second attachment member include metals, steel, aluminum, rigid materials, non-conductive materials, plastics, rigid plastics, fiberglass, graphite, and any other materials considered suitable for a particular embodiment.

Figure 3:
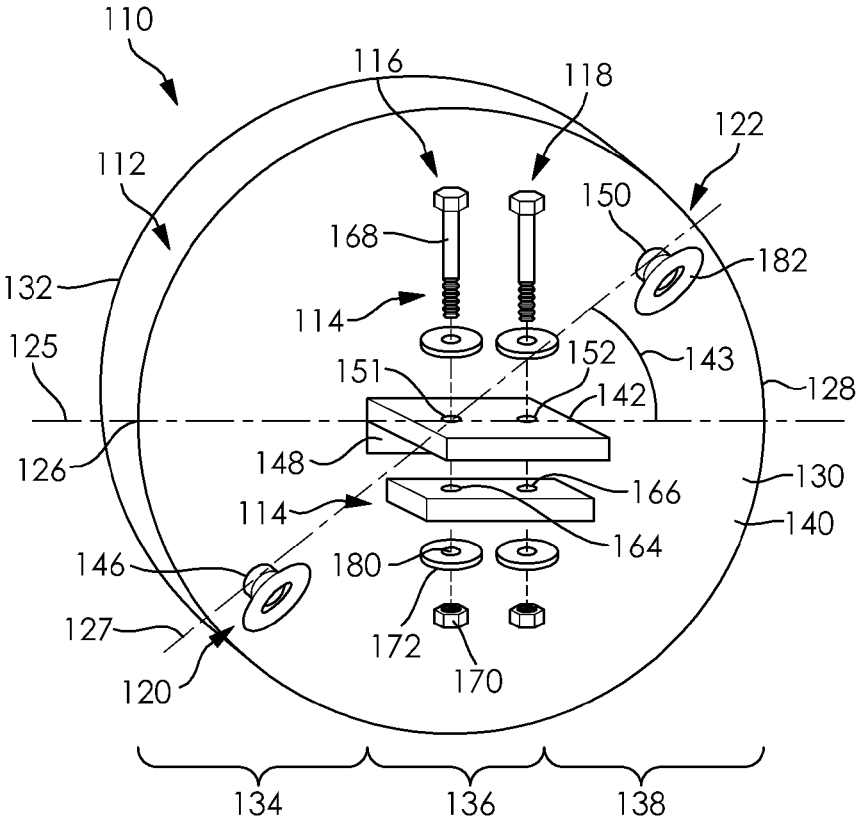
FIG. 3 is a perspective view of another embodiment of a device for remotely operating a switch.

FIG. 3 illustrates another example embodiment of a device 110 for remotely operating a switch. The device 110 is similar to device 10 illustrated in FIGS. 1 and 2 and described above, except as detailed below. With respect to device 110, reference numbers in FIG. 3 refer to the same structural element or feature referenced by the same number in FIGS. 1 and 2, offset by 100. In the illustrated embodiment, the device 110 comprises a plate 112, a connecting member 114, a first fastener 116, a second fastener 118, a first attachment member 120, and a second attachment member 122.

In the illustrated embodiment, the plate 112 has a lengthwise axis 125, first end 126, a second end 128, a first side 130, a second side 132, a first end portion 134, an intermediate portion 136, a second end portion 138, and a body 140. The body 140 defines a projection 142, a first passageway 146, a second passageway 148, a third passageway 150, a fourth passageway 151, and a fifth passageway 152. The lengthwise axis 125 extends through the first end 126, the second end 128, and the length of the second passageway 148. The first end portion 134 extends from the first end 126 to the intermediate portion 136. The intermediate portion 136 extends from the first end portion 134 to the second end portion 138. The second end portion 138 extends from the intermediate portion 136 to the second end 128.

In the illustrated embodiment, the body 140 defines a circular first side 130 and a circular second side 132 such that the plate 112 forms a cylinder. However, the body of a plate can have any geometric shape considered suitable for a particular embodiment. Example geometric shapes considered suitable to form the body of a plate include cylinders, cuboids, rectangular prisms, triangular prisms, hexagonal prisms, and any other shape considered suitable for a particular embodiment.

The projection 142 extends from the first end of the intermediate portion 136 that meets the first end portion 134 to the second end of the intermediate portion 136 that meets the second end portion 138. The projection 142 extends from the first side 130 and away from the second side 132 a length that is less than the length of a handle (e.g., handle 340, described herein) of a switch to which the device 110 is intended to be attached. However, a plate can include a projection that has any length considered suitable for a particular embodiment. Example lengths considered suitable for a projection include lengths that are greater than, equal to, substantially equal to, or less than, the length of a handle of a switch to which a plate is intended to be attached. In the illustrated embodiment, the projection 142 is orthogonal to the first side 130 and is disposed on a plane that is parallel to the lengthwise axis 125 of the plate 112. However, a plate can define a projection at any suitable angle to a first side of the plate. For example, a projection can be defined at an angle to the first side of a plate that is not equal to 90 degrees.

Each of the first passageway 146, the second passageway 148, and the third passageway 150 extends from the first side 130 to the second side 132. Each of the first passageway 146 and third passageway 150 is sized and configured to receive an attachment member 120, 122. In the embodiment illustrated, the second passageway 148 is cuboidal and is sized and configured to receive a portion of a handle of a switch (e.g., handle 340). While the second passageway 148 is illustrated as being cuboidal, a second passageway defined by a plate can have any structural arrangement considered suitable for a particular embodiment. Example structural arrangements considered suitable to define a second passageway include structural arrangements that are cylindrical, cuboidal, and any structural configuration capable of receiving a portion of a handle of a switch (e.g., handle of a switch).

An axis 127 extends through the first passageway 146, the second passageway 148, and the third passageway 150. The axis 127 is disposed at an angle 143 to the lengthwise axis 125 of the plate 112. In the illustrated embodiment, the angle 143 is equal to 45 degrees. While the angle 143 is illustrated as being equal to 45 degrees, a lengthwise axis of a plate and an axis that contains a first passageway, a second passageway, and a third passageway can be defined at any suitable angle to one another. Example angles considered suitable include angles between 1 degree and 180 degrees, angles between about 1 degree and about 180 degrees, acute angles, obtuse angles, and any other angle considered suitable for a particular embodiment.

The fourth passageway 151 and fifth passageway 152 are defined on the projection 142 and extend from a first side of the projection 142 to a second side of the projection 142. Each of the fourth passageway 151 and the fifth passageway 152 is disposed on a plane that is parallel to the first side 130 of the plate 112. In the illustrated embodiment, each of the fourth passageway 151 and the fifth passageway 152 is offset from a plane that contains the center of the plate 112. While each of the fourth passageway 151 and the fifth passageway 152 is illustrated as being disposed on a plane that is parallel to the first side 130 of the plate 112 and as being offset from a plane that contains the center of the plate 112, a passageway defined on a projection of a plate can be defined at any suitable angle relative to the first side of a plate and/or can be positioned such that it is disposed on a plane that contains the center of the plate.

To releasably attach the connecting member 114 to the plate 112, a bolt 168 is passed through the passageway 180 of a first washer of the plurality of washers 172, then through a passageway defined by the plate 112 (e.g., fourth passageway 151, fifth passageway 152), then through a passageway defined by the connecting member 114 (e.g., first passageway 164, second passageway 166), then through a passageway 180 defined by a second washer of the plurality of washers 172, and then is threaded with a nut 170. To releasably attach an attachment member 120, 122 to the plate 112, an eye bolt 182 is passed through a passageway (e.g., first passageway 146, third passageway 150) and then is threaded with a nut (not illustrated).

Alternative embodiments can omit the inclusion of a projection, a connecting member, a first fastener, and/or a second fastener such that the plate is attached to a portion of a handle of a switch using an element that is not disposed through a portion of the plate (e.g., a fastener). For example, a device for remotely operating a switch can include a plate that does not define a projection and omits a connecting member. In these embodiments, after the plate has been positioned on the component or feature to which it is intended to be attached, a fastener can be passed through an opening defined by the component or feature to which the device is intended to be attached such that the device is releasably attached to the component or feature. Example fasteners considered suitable to attach a plate to another component or feature include snap-fit fasteners, clevis pins, cotter pins, threaded members, such as bolts, U-bolts, screws, nuts, wingnuts, clamps, and any other fastener considered suitable for a particular embodiment.

While the connecting member 114 is illustrated as having a particular structural configuration, a connecting member included in a device for remotely operating a switch can have any suitable shape, size, and configuration, and the illustrated connecting member is merely an example of a suitable connecting member. For example, a connecting member can be formed such that it defines one or more bends and/or defines one passageway or more than two passageways. Alternative embodiments can include a connecting member that is an integrated component of a plate. For example, a connecting member, such as those described herein, can be directly attached to a plate such that it forms a portion of the plate.

Figure 3A:
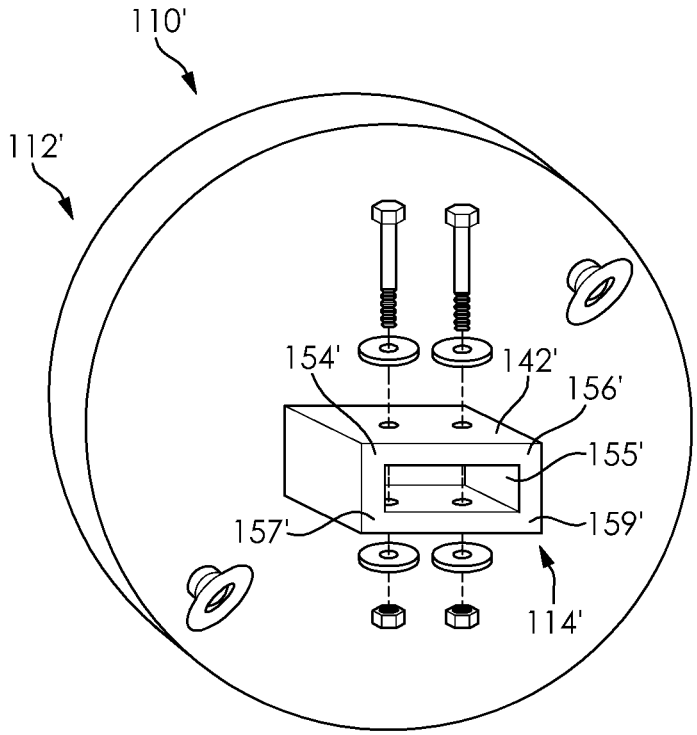
FIG. 3A is a perspective of the device illustrated in FIG. 3 with an alternative plate and connecting member.

Another example embodiment that includes a connecting member directly attached to a plate is illustrated in FIG. 3A. The plate 112' and connecting member 114' are similar to the plate 112 and connecting member 114 illustrated in FIG. 3 and described herein, except as described. With respect to plate 112' and connecting member 114', reference numbers in FIG. 3A refer to the same structural element or feature referenced by the same number in FIG. 3, offset by '. In the illustrated embodiment, each of the first end 154' and second end 156' of the connecting member 114' is directly attached to the projection 142' such that the plate 112' and connecting member 114' cooperatively define a passageway 155'. The passageway 155' is in communication with the second passageway 148' defined by the plate 112' and is sized and configured to receive a portion of a component or feature to which the device for remotely operating a switch is intended to be attached (e.g., handle of a switch). The first end 154' and the second end 156' can be attached to the plate 112' using any suitable structure or method of attachment. Example structures or methods of attachment considered suitable to attach a connecting member to a plate include welding, fusing, using adhesives, snap-fit fasteners, threaded members, such as bolts, screws, nuts, wingnuts, and any other structure or method of attachment considered suitable for a particular embodiment. In the illustrated embodiment, the connecting member 114' is welded to the plate 112'. Alternative, or in combination with, attaching a first end and a second end of a connecting member to a plate, a side of a connecting member can be attached to a plate using any suitable structure or method of attachment, such as those described herein.

The connecting member 114' defines a first bend 157' and a second bend 159' between the first end 154' and the second end 156' of the connecting member 114'. Each of the first bend 157' and the second bend 159' is defined at a 90 degree angle relative to the intermediate portion of the connecting member 114'. While the connecting member 114' has been illustrated as defining a first bend 157' and a second bend 159' at a 90 degree angle relative to the intermediate portion of the connecting member 114', a connecting member can define any suitable number of bends at any suitable angle relative to an intermediate portion of a connecting member. Example number of bends considered suitable to define on a connecting member include one, at least one, two, a plurality, three, four, and any other number considered suitable for a particular embodiment. Example angles considered suitable to define a bend relative to the intermediate portion of a connecting member include angles between 1 degree and 180 degrees, angles between about 1 degree and about 180 degrees, angles between 45 degrees and 135 degrees, angles between about 45 degrees and about 135 degrees, acute angles, obtuse angles, and any other angle considered suitable for a particular embodiment.

Figure 4:
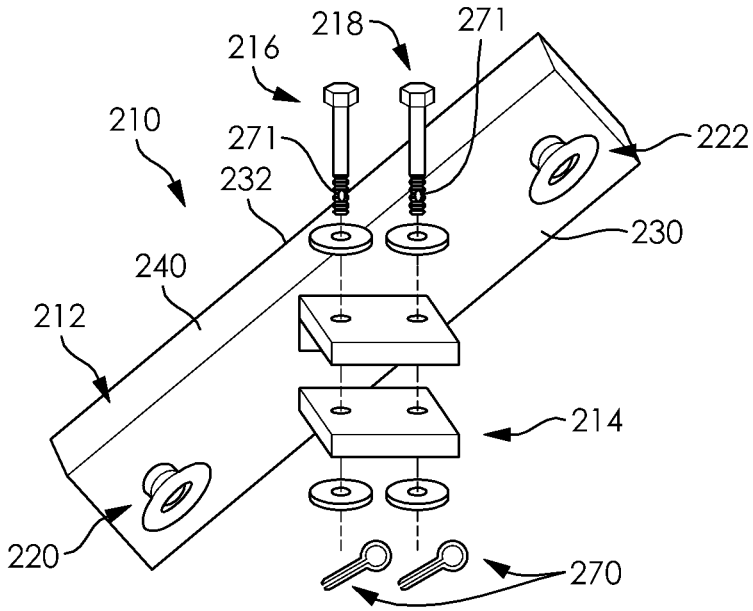
FIG. 4 is a perspective view of another embodiment of a device for remotely operating a switch.
Figure 5:
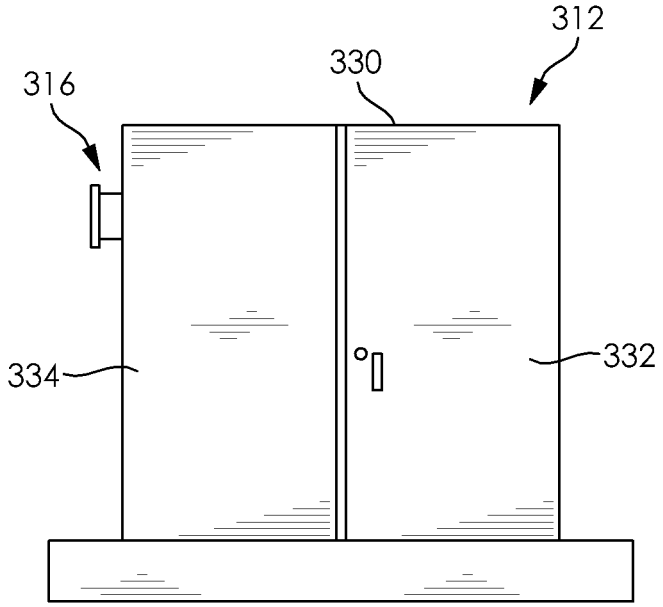
FIG. 5 is an elevation view of a cabinet that houses a transformer, a switch, and an example embodiment of a system for remotely operating a switch.

FIG. 4 illustrates another example embodiment of a device 210 for remotely operating a switch. The device 210 is similar to device 110 illustrated in FIG. 3 and described above, except as detailed below. With respect to device 210, reference numbers in FIG. 4 refer to the same structural element or feature referenced by the same number in FIG. 3, offset by 100. Thus, the device 210 comprises a plate 212, a connecting member 214, a first fastener 216, a second fastener 218, a first attachment member 220, and a second attachment member 222.

In the illustrated embodiment, the body 240 defines a rectangular first side 230 and a rectangular second side 232 such that the plate 212 is cuboidal (e.g., rectangular prism). Alternative to securing the fasteners 216, 218 using a nut, each of the first fastener 216 and second fastener 218 includes cotter pin 270. The bolt 268 included in each fastener 216, 218 defines a passageway 271 that is sized and configured to receive a portion of a cotter pin 270.

FIGS. 5, 6, 7, 8, and 9 illustrate a cabinet 312 that houses a transformer 313, a switch 314, and an example embodiment of a system 310 for remotely operating a switch. In the illustrated embodiment, the system 310 is disposed within the cabinet 312 and comprises the device 10 for remotely operating a switch, as shown in FIGS. 1 and 2, an exterior housing 316, an elastic member 318, a first wire member 320, a second wire member 322, a first indicator 324, a second indicator 326, and a pulling member 328.

While system 310 is illustrated as including device 10 for remotely operating a switch, a system for remotely operating a switch can include any suitable device for remotely operating a switch. Example devices considered suitable to include in a system for remotely operating a switch include device 10 for remotely operating a switch, device 110 for remotely operating a switch, device 210 for remotely operating a switch, variations of the devices described herein, and any other device considered suitable for a particular embodiment.

In the illustrated embodiment, the cabinet 312 comprises a body 330, a first door 332, and a second door 334. The body 330, the first door 332, and the second door 334 cooperatively define a chamber 336 that houses the transformer 313 and the switch 314. The body 330 defines a passageway 338 that provides access between the chamber 336 and an environment exterior to the body 330 of the cabinet 312.

Figure 6:
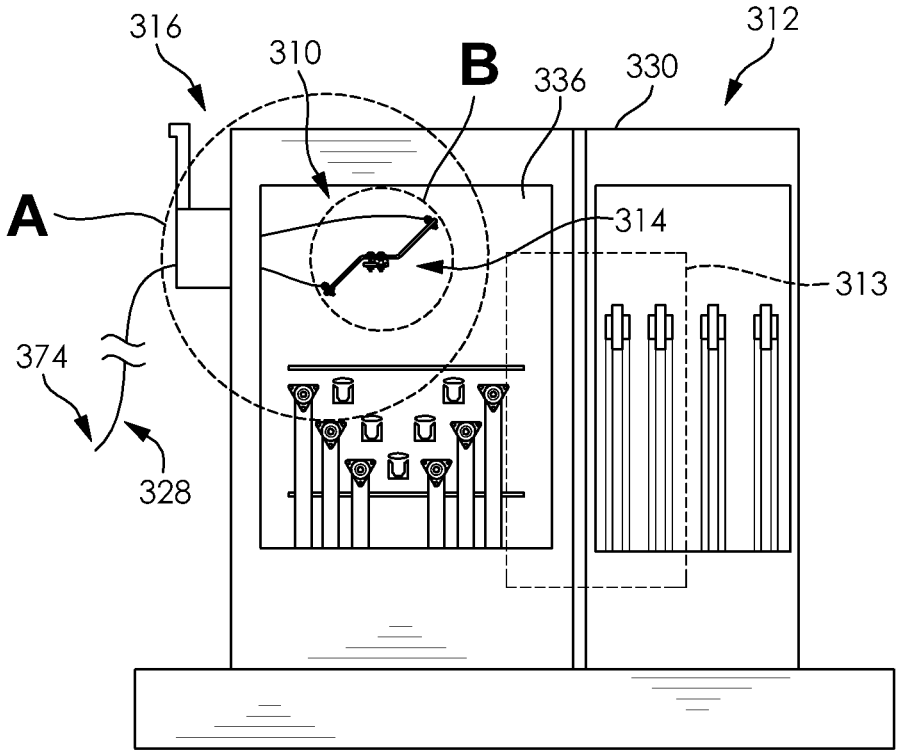
FIG. 6 is an elevation view of the cabinet illustrated in FIG. 5 with its doors removed to show the components of the system for remotely operating a switch relative to the cabinet. The system for remotely operating a switch includes the device illustrated in FIGS. 1 and 2. The device for remotely operating a switch is in a first position.
Figure 7:
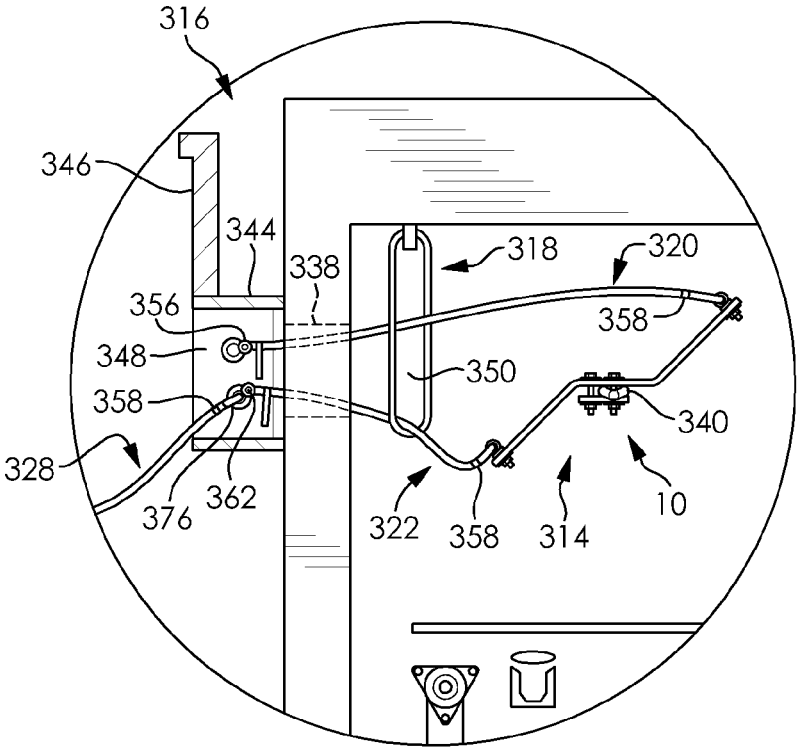
FIG. 7 is a magnified view of area A illustrated in FIG. 6. The device for remotely operating a switch is in a first position.
Figure 8:
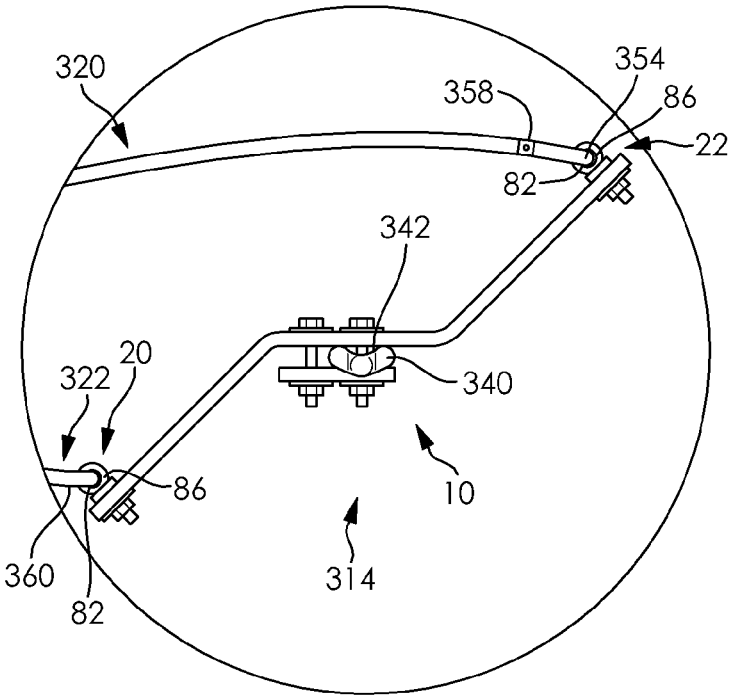
FIG. 8 is a magnified view of area B illustrated in FIG. 6. The device for remotely operating a switch is in a first position.
Figure 9:
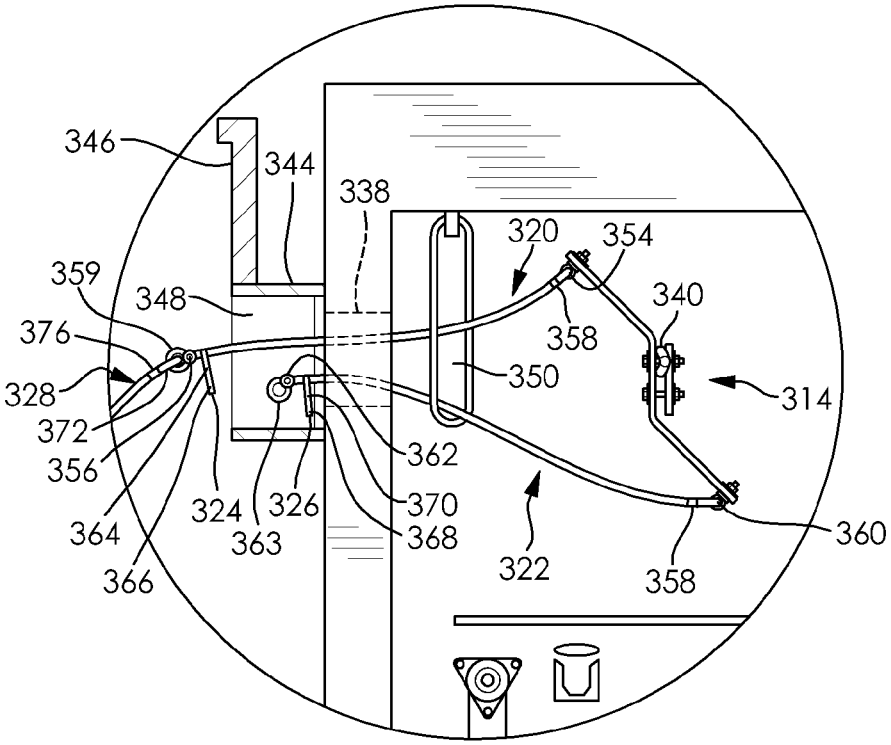
FIG. 9 is a partial elevation view of the cabinet illustrated in FIG. 5 with its doors removed to show the components of the system for remotely operating a switch relative to the cabinet. The device for remotely operating a switch is in a second position.

In the illustrated embodiment, the switch 314 is attached to the body 330 of the cabinet 312 and is communication with the transformer 313. As shown in FIG. 8, the switch 314 has a handle 340 that defines a passageway 342 and is moveable between a closed state and an open state. Movement of the switch 340 between the closed state and the open state moves the transformer 313 between an energized state and a de-energized state. The handle 340 is rotatably attached to the switch 314 such that it is moveable between a first position, as shown in FIGS. 6, 7, and 8, and a second position, as shown in FIG. 9. Movement of the handle 340 between the first position and the second position moves the switch 340 between the closed state and the open state. The switch 314 is in the closed state, and the transformer 313 is in an energized state, when the handle 340 is in the first position and the switch 314 is in the open state, and the transformer 313 is in a de-energized state, when the handle 340 is in the second position.

While the switch 314 is described as being in communication with the transformer 313, a switch manipulated by the devices and/or systems described herein can be in communication with any suitable device, component, or system considered suitable for a particular embodiment, such as a switchgear, or other electrical devices. The devices and/or systems described herein can be used to remotely operate a switch having any suitable structural arrangement that is in communication with any device or component.

In the illustrated embodiment, the switch 314 comprises a two-position horizontally mounted loadbreak switch. An example two-position loadbreak switch considered suitable to mount the devices and systems described herein is illustrated and described in Cooper Power Systems Two-Position Sidewall (Horizontal) and Cover (Vertical) Mounted Loadbreak Switch (Electrical Apparatus 800-65) publication, published in 2012, the entire contents of which is hereby incorporated into this disclosure by reference.

In the illustrated embodiment, the device 10 for remotely operating a switch is releasably attached to the handle 340 of the switch 314 such that movement of the device 10 results in movement of the handle 340. The device 10 has a first position and a second position. The handle 340 is in the first position when the device 10 is in the first position and the handle 340 is in the second position when the device 10 is in the second position.

To releasably attach the device 10 to the handle 340 the plate 12 of the device 10 is positioned on, and contacts, a first side of the handle 340 and the connecting member 14 is positioned on, and contacts, a second side of the handle 340. The second side of the handle 340 is opposably facing the first side of the handle 340. A first fastener 16 and/or second fastener 18 are then passed through the plate 12, the connecting member 14, and/or the handle 340 and are secured, as described herein. In the illustrated embodiment, a first bolt 68 is passed through the passageway 80 of a first washer of the plurality of washers 72. Subsequently, the first bolt 68 is passed through the third passageway 50 defined by the plate 12, the passageway 342 defined by the handle 340 of switch 314, the second passageway 66 defined by the connecting member 14, and then through a passageway 80 defined by a second washer of the plurality of washers 72. Finally, the first bolt 68 is threaded with a first nut 70. A second bolt 68 is passed through the passageway 80 of a third washer of the plurality of washers 72. Subsequently, the second bolt 68 is passed through the second passageway 48 defined by the plate 12, the first passageway 64 defined by the connecting member 14, and then through a passageway 80 defined by a fourth washer of the plurality of washers 72. Finally, the second bolt 68 is threaded with a second nut 70. Both nuts 70 are tightened such that the plate 12 is fixedly attached to the handle 340 and movement of the plate 12 results in movement of handle 340. Optionally, depending on the structural arrangement of the device for remotely operating a switch and/or the structural arrangement of the handle of the switch, a second fastener can be omitted and the device can be releasably attached to the handle of the switch using a single fastener that passes through the handle of a switch. While bolts 68 and nuts 70 are illustrated as providing releasable attachment between the device 10 and the handle 340, any suitable structure or method of attachment can be used to provide releasable attachment between these components, as described herein. Optionally, depending on the structural arrangement of the device for remotely operating a switch and/or the structural arrangement of the component or feature to which the device is intended to be attached, the device for remotely operating a switch can be attached to the component or feature without a connecting member using one or more fasteners, such as those described herein.

While device 10 is illustrated as being releasably attached to the switch 314, alternative embodiments can include switches in which the handle of the switch comprises a device for remotely operating a switch (e.g., the plate of a device, such as those described herein (e.g., plate 12, plate 112, plate 212)). In these embodiments, the connecting member and fasteners are omitted and the device is moveable between a first position and a second position to move a switch between the closed state and the open state. These embodiments are described in more detail with respect to FIG. 10.

In the illustrated embodiment, the exterior housing 316 has a body 344 and a cover 346 that is hingedly attached to the body 344. The body 344 of the exterior housing 316 is attached to an exterior surface of the body 330 of the cabinet 312 that is disposed 90 degrees relative to the front of the body 330 (e.g., first door 332, second door 334). It is considered advantageous, but not required, to position an operator, a first wire member, a second wire member, and/or an exterior housing on a side of the housing of a cabinet that is disposed at an angle (e.g., 90 degrees) to the front of the housing (e.g., the first door 332, second door 334) to avoid injury when the handle of a switch is moved between its first and second positions. For example, an operator can manipulate a first wire member and/or a second wire member while positioned on a side of the housing of the cabinet that is disposed at an angle to the front of the housing while the first door and/or second door of the cabinet are closed to avoid exposure to dangerous conditions, such as an arc flash. In the embodiment illustrated, the body 344 of the exterior housing 316 is sealed with the body 330 of the cabinet 312 such that a watertight seal is provided between the two components. However, alternative embodiments can include an exterior housing that is formed as part of a housing such that it is an integrated component of the housing. The body 344, the cover 346, and a portion of the exterior surface of the body 330 cooperatively define a chamber 348. Alternatively, the body of an exterior housing can define a chamber independent of the body of a cabinet. The exterior housing 316 is attached to the body 330 of the cabinet 312 such that the chamber 348 is in communication with the passageway 338 defined by the body 330 of the cabinet 312. While not illustrated, an exterior housing can optionally include structure for locking a cover to the body of an exterior housing to prevent unauthorized access to the chamber defined by the body of the exterior housing. Optionally, an exterior housing can be omitted from a system for remotely operating a switch.

The exterior housing 316 can be attached to the body 330 of the cabinet 312 using any suitable structure or method of attachment considered suitable for a particular embodiment. Example structures and methods of attachment considered suitable to attach an exterior housing to a cabinet include threaded components, adhesives, welding, fusing, and any other structure or method of attachment considered suitable for a particular embodiment.

The elastic member 318 is attached to an interior surface of the body 330 of the cabinet 312 and is disposed between the device 10 for remotely operating a switch and the passageway 338 defined by the body 330 of the cabinet 312. The elastic member 318 defines a passageway 350 that is sized and configured to receive a portion of the first wire member 320 and a portion of the second wire member 322, as described in more detail herein. The elastic member 318 can be formed of any suitable material that is capable of deforming when a force is applied to the elastic member 318 and returning to its original, or to a substantially original, configuration once the force is removed from the elastic member 318. Example materials considered suitable to form an elastic member include spring materials, polymers, deformable polymers, rubber, and any other material considered suitable for a particular embodiment. In the illustrated embodiment, the elastic member 318 is formed of spring material.

The first wire member 320 has a first end 354, a second end 356, and a length that extends from the first end 354 to the second end 356. The first end 354 of the first wire member 320 is attached to the second attachment member 22 of device 10 and the second end 356 of the first wire member 320 is disposed within the chamber 348 of the exterior housing 316, unless the first wire member 320 is being used to manipulate the handle 340. The first wire member 320 extends from the first end 354, through the passageway 350 defined by the elastic member 318, to the second end 356.

In the illustrated embodiment, a first portion of the first wire member 320 has been passed through the passageway 86 defined by the eye bolt 82 and is attached to a second portion of the first wire member 320 using a ferrule 358. The second end 356 of the first wire member 320 is formed as a loop 359 such that a third portion of the first wire member 320 is attached to a fourth portion of the first wire member 320 using a ferrule 358. While the first end 354 of the first wire member 320 is illustrated as being passed through the second attachment member 22, a first wire member can be attached to a second attachment member using any structure or method of attachment considered suitable for a particular embodiment. Alternatively, a device for remotely operating a switch can omit the inclusion of a second attachment member and a first wire member can be directly attached to a plate of a device for remotely operating a switch. For example, a first portion of a first wire member can be directly attached to the plate or be passed through a passageway defined by the plate and be attached to a second portion of the first wire member. Example structures or methods of attachment considered suitable to attach a wire member to an attachment member and/or a plate include using a hook, a portion of the wire member, knots, welding, fusing, adhesives, and any other structure or method of attachment considered suitable for a particular embodiment.

The second wire member 322 has a first end 360, a second end 362, and a length that extends from the first end 360 to the second end 362. In the illustrated embodiment, the second wire member 322 has a length that is less than the length of the first wire member 320. However, depending on the structural arrangement of the device and/or system used to accomplish movement of a switch from a first position to a second position, alternative embodiments can include a first wire member that has a length that is less than, equal to, substantially equal to, or greater than the length of a second wire member. The first end 360 of the second wire member 322 is attached to the first attachment member 20 of device 10 and the second end 362 of the second wire member 322 is disposed within the chamber 348 of the exterior housing 316, unless the second wire member 322 is being used to manipulate the handle 340. The second wire member 322 extends from the first end 360, through the passageway 350 defined by the elastic member 318, to the second end 362.

In the illustrated embodiment, a first portion of the second wire member 322 has been passed through the passageway 86 defined by the eye bolt 82 and is attached to a second portion of the second wire member 322 using a ferrule 358. The second end 362 of the second wire member 322 is formed as a loop 363 such that a third portion of the second wire member 322 is attached to a fourth portion of the second wire member 322 using a ferrule 358. While the first end 360 of the second wire member 322 is illustrated as being passed through the first attachment member 20, a second wire member can be attached to a first attachment member using any structure or method of attachment considered suitable for a particular embodiment. Alternatively, a device for remotely operating a switch can omit the inclusion of a first attachment member and a second wire member can be directly attached to a plate of a device for remotely operating a switch. For example, a first portion of a second wire member can be directly attached to the plate or be passed through a passageway defined by the plate and be attached to a second portion of the second wire member. Example structures or methods of attachment considered suitable to attach a wire member to an attachment member and/or a plate include using a hook, a portion of the wire member, knots, welding, fusing, adhesives, and any other structure or method of attachment considered suitable for a particular embodiment.

While a ferrule 358 is illustrated as attaching a portion of the first wire member 320 to the first wire member 320 and a portion of the second wire member 322 to the second wire member 322, any suitable structure or method of attachment can be used for a particular embodiment. Example structures and methods of attachment considered suitable to attach a portion of a wire member to the wire member include wire clips, welding, fusing, ferrules, and any other structure or method of attachment considered suitable for a particular embodiment.

The first wire member 320 and second wire member 322 are configured to move the device 10 between its first position and second position such that the handle 340 of the switch 314 moves between its first and second positions. In the illustrated embodiment, the first wire member 320 has a first position and a second position. The device 10 is in the first position and the switch 314 is in the closed state when the first wire member 320 is in the first position. Thus, the transformer 313 is in an energized state when the first wire member 320 is in the first position. This is shown in FIGS. 6, 7, and 8. The device 10 is in the second position and the switch 314 is in the open state when the first wire member 320 is in the second position. Thus, the transformer 313 is in a de-energized state when the first wire member 320 is in the second position. This is shown in FIG. 9.

The second wire member 322 has a first position and a second position. The device 10 is in the first position and the switch 314 is in the closed state when the second wire member 322 is in the second position. Thus, the transformer 313 is in an energized state when the second wire member 322 is in the second position. This is shown in FIGS. 6, 7, and 8. The device 10 is in the second position and the switch 314 is in the open state when the second wire member 322 is in the first position. Thus, the transformer 313 is in a de-energized state when the second wire member 322 is in the first position. This is shown in FIG. 9.

In the illustrated embodiment, the first indicator 324 is attached to the second end 356 of the first wire member 320 and comprises a body 364 that has one or more indicia 366. The one or more indicia 366 has/have a form that corresponds to the state of the switch 314 when the first wire member 320 is in the second position. In the illustrated embodiment, the one or more indicia 366 has/have a form that corresponds to the open state of the switch 314 when the first wire member 320 is in the second position. Alternatively, the one or more indicia of a first indicator can have a form that corresponds to the de-energized state of a transformer when a first wire member is in the second position. Optionally, a first indicator can be omitted from a system for remotely operating a switch.

The second indicator 326 is attached to the second end 362 of the second wire member 322 and comprises a body 368 that has one or more indicia 370. The one or more indicia 370 has/have a form that corresponds to the state of the switch 314 when the second wire member 322 is in the second position. In the illustrated embodiment, the one or more indicia 370 has/have a form that corresponds to the closed state of the switch 314 when the second wire member 322 is in the second position. Alternatively, the one or more indicia of a second indicator can have a form that corresponds to the energized state of a transformer when a second wire member is in the second position. Optionally, a second indicator can be omitted from a system for remotely operating a switch.

Each of the one or more indicia 366, 370 included on the first and second indicators 324, 326 can be formed using any suitable structure or technique. For example, each indicium of the one or more indicia can be formed as a raised projection extending outward from the body of an indicator, as a recess extending into the body of an indicator, can be embedded within the material that forms an indicator, and/or can be applied to the body of an indicator using ink or other visually identifiable material. Alternative to having one or more indicia, an indicator can be formed of a material that corresponds to the state of the switch and/or transformer when the first and/or second wire member is in the second position. For example, a first indicator can be formed of a first material (e.g., green material) and a second indicator can be formed of a second material (e.g., red material) that is different than the first material.

The first indicator 324 can be attached to the first wire member 320 and the second indicator 326 can be attached to the second wire member 322 using any suitable structure or method of attachment considered suitable for a particular embodiment. Example structures or methods of attachment considered suitable to attach an indicator to a wire member include using a hook, a portion of the wire member, knots, welding, fusing, adhesives, and any other structure or method of attachment considered suitable for a particular embodiment. In the illustrated embodiment, the first indicator 324 is disposed between the loop 359 of the first wire member 320 and the first end 354 of the first wire member 320 and the second indicator 326 is disposed between the loop 363 of the second wire member 322 and the first end 360 of the second wire member 322.

In the illustrated embodiment, the pulling member 328 has a first end 372, a second end 374, and a hook 376 that is attached to the first end 372 of the pulling member 328.

The hook 376 can be attached to the pulling member 328 using any suitable structure or method of attachment. In the illustrated embodiment, a first portion of the pulling member 328 has been passed through a passageway defined by the hook 376 and is attached to a second portion of the pulling member 328 using a ferrule 358. While a hook 376 is illustrated as being attached to a pulling member 328, any suitable attachment member can be attached to a pulling member to accomplish releasable attachment between the pulling member and a wire member according to a particular embodiment. Example attachment members considered suitable to attach to a pulling member include snap hooks, leash clips, and any other attachment members considered suitable for a particular embodiment. Optionally, a pulling member can be omitted from a system for remotely operating a switch.

The pulling member 328 has a length that is about 30 feet. However, the length of a pulling member can be any suitable length capable of positioning an operator a distance from a cabinet that is sufficient to avoid being exposed to dangerous conditions, such as an arc flash. Example lengths considered suitable for a pulling member include lengths between 1 foot and 30 feet, lengths equal to, substantially equal to, or about, 30 feet, 15 feet, 10 feet, 5 feet, 4 feet, 3 feet, 2 feet, and/or 1 foot, and any other length considered suitable for a particular embodiment.

In FIGS. 6 and 7, the pulling member 328 is releasably attached to the second end 362 of the second wire member 322. This is accomplished by releasably attaching a portion of loop 363 to hook 376. In FIG. 9, the pulling member 328 is releasably attached to the second end 356 of the first wire member 320. This is accomplished by releasably attaching a portion of loop 359 to hook 376.

While attachment between the pulling member 328 and the first wire member 320 and/or second wire member 322 is illustrated as being accomplished by attaching a portion of a loop 359, 363 to the hook 376, a pulling member can be releasably attached to a wire member using suitable structure or technique and will depend on the structural arrangement of the pulling member and/or the wire member. Alternatively, a wire member can be used as the pulling member. In these alternative embodiments, each of the wire members has a length that positions an operator a distance from a cabinet that is sufficient to avoid being exposed to dangerous conditions, such as an arc flash. Example lengths considered suitable for a wire member include lengths between 1 foot and 30 feet, lengths equal to, substantially equal to, or about, 30 feet, 15 feet, 10 feet, 5 feet, 4 feet, 3 feet, 2 feet, and/or 1 foot, and any other length considered suitable for a particular embodiment.

While one pulling member 328 is illustrated as included with system 310, any suitable number of pulling members can be included in a system for remotely operating a switch. Example numbers of pulling members considered suitable to include in a system for remotely operating a switch include one, at least one, two, a plurality, three, four, and any other number considered suitable for a particular embodiment. While pulling member 328 is illustrated as being attached to only one wire member during use, a pulling member can be attached to any suitable number of wire members, such as only one wire member, at least one wire member, at least one of the first wire member or second wire member, at least two wire members, and any other number of wire members considered suitable for a particular embodiment.

Figure 15:
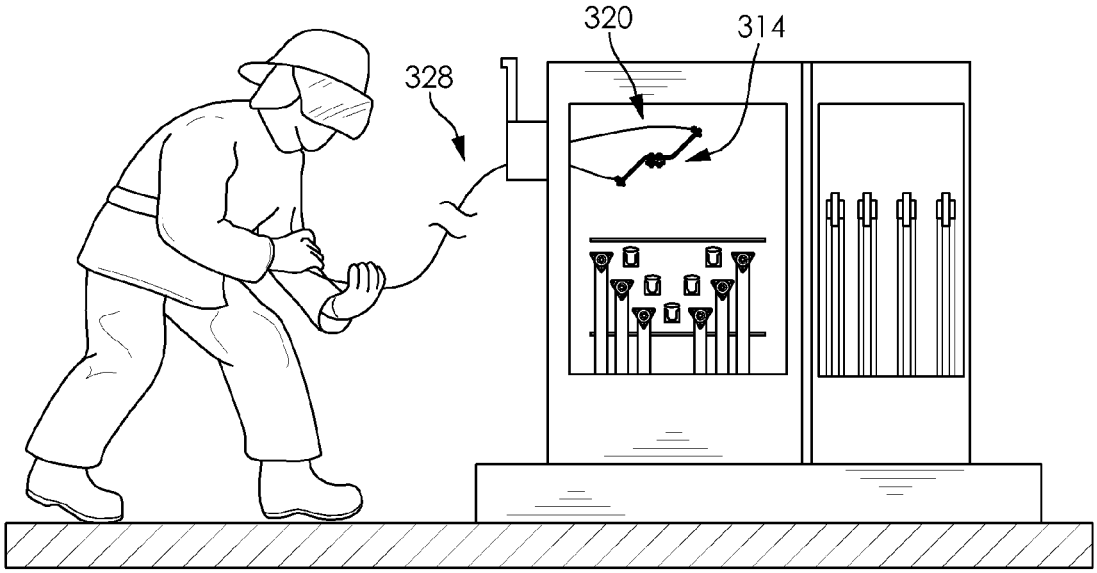
FIG. 15 is an elevation view of an operator remotely operating a switch using an example embodiment of a system for remotely operating a switch.

When it is desired to move the switch 314 from the closed position, as shown in FIGS. 6, 7, and 8 to the open position, as shown in FIG. 9, an operator attaches the pulling member 328 to the second end 356 of the first wire member 320 and applies an axial force on the pulling member 328 and the first wire member 320 in a direction away from the switch 314 (e.g., orthogonal to the axis on which the switch 314 rotates). The magnitude of the axial force applied to the pulling member 328 and the first wire member 320 will vary depending on the structural arrangement of the switch being manipulated. The axial force applied to the first wire member 320 should be continued and/or increased until the handle 340 of the switch 314 moves from the first position to the second position. Tactile feedback will be provided to the operator when the switch 340 moves from the closed position to the open position and, when the tactile feedback is received, the axial force being applied to the pulling member 328 and the first wire member 320 can be removed. FIG. 15 illustrates an operator applying an axial force on the pulling member 328 and the first wire member 320 to move the handle 314 to the second position.

When it is desired to move the switch 314 from the open position, as shown in FIG. 9, to the closed position, as shown in FIGS. 6, 7, and 8, an operator attaches the pulling member 328 to the second end 362 of the second wire member 322 and applies an axial force on the pulling member 328 and the second wire member 322 in a direction away from the switch 314 (e.g., orthogonal to the axis on which the switch 314 rotates). The magnitude of the axial force applied to the pulling member 326 and the second wire member 322 will vary depending on the structural arrangement of the switch being manipulated. The axial force applied to the second wire member 322 should be continued and/or increased until the handle 340 of the loadbreak switch 314 moves from the second position to the first position. Tactile feedback will be provided to the operator when the switch 340 moves from the open position to the closed position and, when the tactile feedback is received, the axial force being applied to the pulling member 328 and the second wire member 322 can be removed.

Optionally, a wire member can be color-coded such that is has a portion formed of, or that includes, a colored material (e.g., paint) to provide an indication to the operator as to the current state of a switch. A first wire member can be formed of, or include, a green material along the portion of the length of the first wire member that is disposed within the cabinet when the first wire member is in the first position. A second wire member can be formed of, or include, a red material along the portion of the length of the second wire member that is disposed within the cabinet when the second wire member is in the first position. During use, when the first wire member is moved from the first position to the second position the green material becomes visible to an operator and the red material becomes concealed from the operator. In addition, when the second wire member is moved from the first position to the second position the red material becomes visible to an operator and the green material becomes concealed from the operator.

Figure 11:
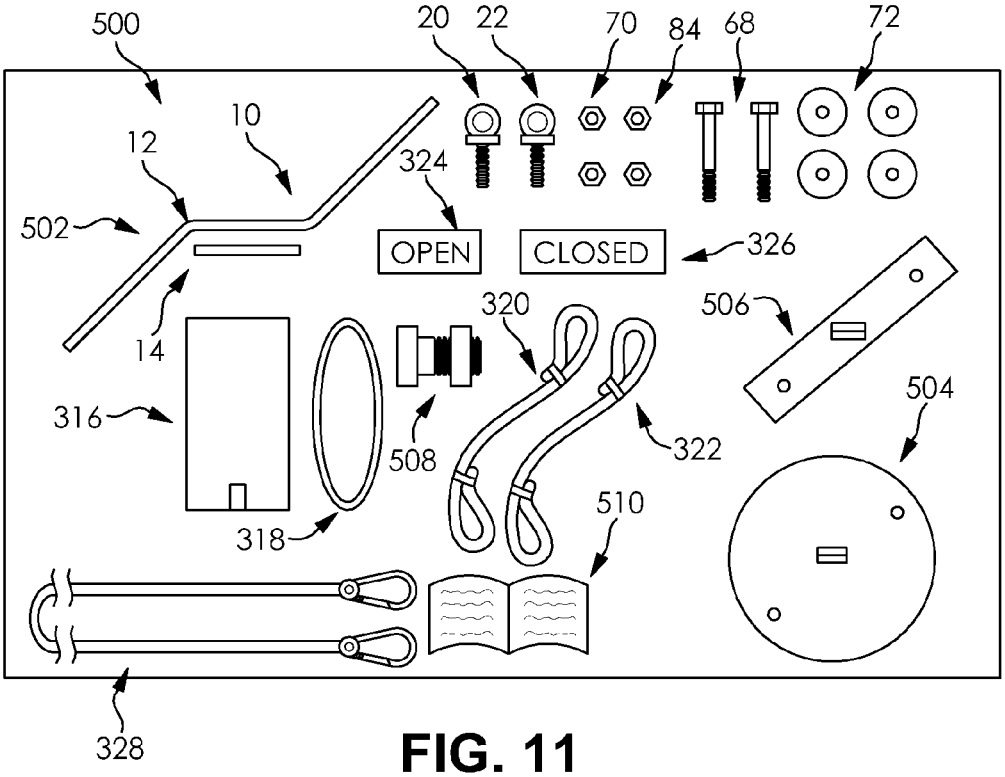
FIG. 11 is a top view of an example embodiment of a kit that includes a system for remotely operating a switch. The kit includes the devices illustrated in FIGS. 1 and 2, FIG. 3, and FIG. 4 and the system illustrated in FIGS. 5, 6, 7, 8, and 9.

Optionally, system 310 can include a tubular member that can be positioned within the passageway 338 defined by the body 330 of the cabinet 312 to reduce the contact between a wire member 320, 322 and the body 330 of the cabinet 312. A suitable tubular member 508 is illustrated in FIG. 11 and is sized and configured to receive a portion of a wire member and/or pulling member. The tubular member can be attached to the body 330 of the cabinet 312 using any suitable structure or method of attachment, such as threaded connections, adhesives, or any other structure or method of attachment considered suitable for a particular embodiment. For example, as illustrated in FIG. 11, a suitable tubular member comprises a first threaded member that has a flange and a second threaded member that is sized and configured to be mated with the threads of the first threaded member. To attach the tubular member to the cabinet 312, the first threaded member can be positioned on a first side of the body 330 of the cabinet 312 (e.g., within chamber 348) and the second threaded member can be positioned on a second side of the body 330 of the cabinet 312 (e.g., within chamber 336). The second threaded member can then be mated with the first threaded member to achieve attachment of the tubular member to the body 330 of the cabinet 312. Optionally, a portion of the body 344 of the exterior housing 316 can be positioned between the first threaded member and the first side of the body 330 of the cabinet 312 before attachment of the second threaded member to the first threaded member to assist with attachment of the exterior housing 316 to the body 330.

While a particular structural arrangement has been illustrated for a tubular member, a tubular member can have any suitable structural arrangement and can comprise any suitable element capable of defining a passageway and/or providing releasable attachment between an exterior housing and a cabinet. Examples of suitable tubular members include bushings, electrical bushings, hubs, conduit, conduit fittings, and any other member considered suitable for a particular embodiment. Alternative to a housing defining a single passageway, such as that shown in FIG. 7, a housing can define two or more passageways that are each sized and configured to receive a portion of a wire member and/or pulling member. For example, a first wire member can be passed through a first passageway defined by a housing and a second wire member can be passed through a second passageway defined by a housing. Each passageway defined by a housing can optionally include a tubular member, such as those described herein.

Figure 10:
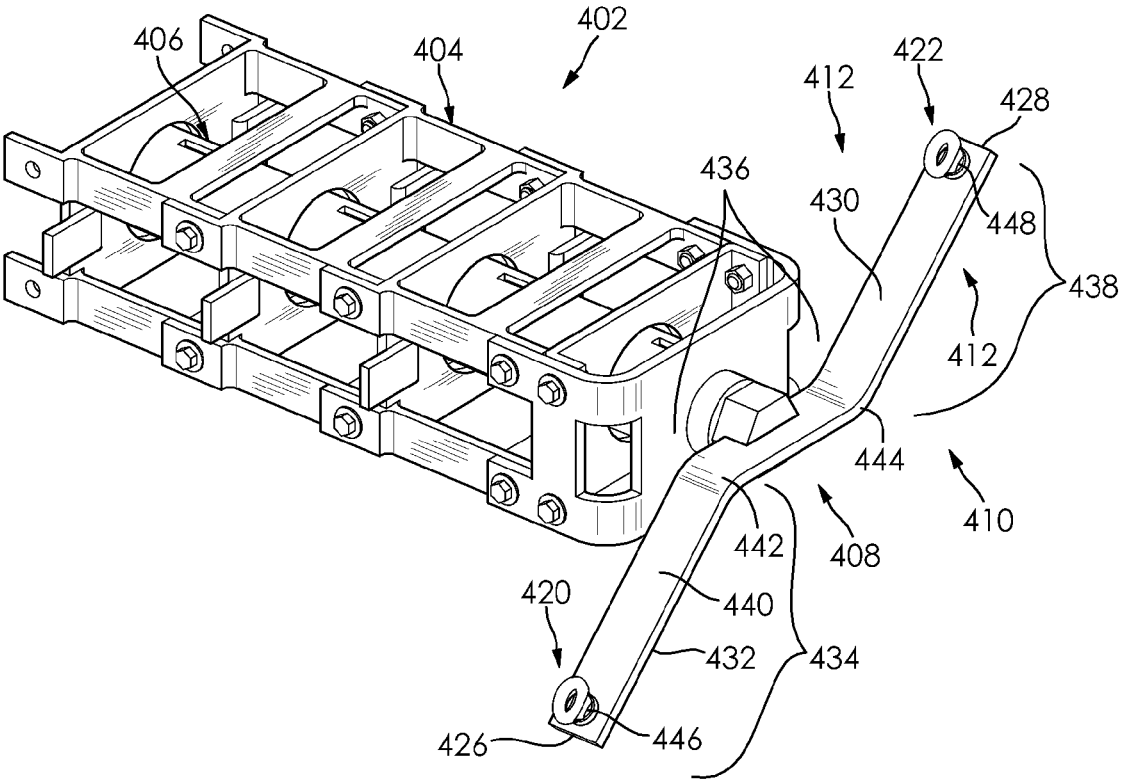
FIG. 10 is an example embodiment of a loadbreak switch that includes a device for remotely operating a switch.

FIG. 10 illustrates an example embodiment of a loadbreak switch 402 that has a housing 404, a switch mechanism 406, and a handle 408. The switch mechanism 406 is disposed within the housing 404 and is attached to the handle 408. The switch mechanism 406 has an open state and a closed state. In use, electrical current flows through the loadbreak switch 402 when the switch mechanism 406 is in the closed state and electrical current is prevented from flowing through the loadbreak switch 402 when the switch mechanism 406 is in the open state. The handle 408 has a first position and a second position. The switch mechanism 406 is in the closed state when the handle 408 is in the first position and the switch mechanism 406 is in the open state when the handle 408 is in the second position.

In the illustrated embodiment, the handle 408 of the loadbreak switch 402 comprises a device 410 for remotely operating a switch. The device 410 is similar to device 10 illustrated in FIGS. 1 and 2 described above, except as detailed below. With respect to device 410, reference numbers in FIG. 10 refer to the same structural element or feature referenced by the same number in FIGS. 1 and 2, offset by 400. As shown, the device 410 comprises a plate 412, a first attachment member 420, and a second attachment member 422.

The plate 412 has a first end 426, a second end 428, a first side 430, a second side 432, a first end portion 434, an intermediate portion 436, a second end portion 438, and a body 440. The body 440 defines a first bend 442, a second bend 444, a first passageway 446, and a second passageway 448. The body 440 defines the first passageway 446 on the first end portion 434 and the second passageway 448 on the second end portion 438. Each of the first passageway 446 and second passageway 448 extends from the first side 430 to the second side 432 and is sized and configured to receive an attachment member 420, 422. Alternatively, each of a first passageway and a second passageway can be sized and configured to receive a portion of a wire member or a pulling member.

While device 410 is illustrated as comprising the handle 408 of a loadbreak switch 402, any of the devices described herein, and variations of the devices described herein, can form the handle of a loadbreak switch. Example devices considered suitable to form the handle of a loadbreak switch include device 10 for remotely operating a switch, device 110 for remotely operating a switch, device 210 for remotely operating a switch, variations of the devices described herein, and any other device considered suitable for a particular embodiment. In embodiments in which a device described herein comprises the handle of a loadbreak switch, the device can omit the inclusion of a connecting member, a first fastener, a second fastener, a first attachment member, and/or second attachment member. While device 410 is illustrated as forming the handle of a loadbreak switch 402, the devices described herein, and variations of the devices described herein, can form the handle of any suitable device, component, or system, such as any device, component, and/or system, capable of moving between a first state and a second state.

FIG. 11 illustrates an example embodiment of a kit 500 that includes a system 502 for remotely operating a switch according to an embodiment, such as system 310; a second device 504 for remotely operating a switch according to an embodiment, such as device 110; a third device 506 for remotely operating a switch according to an embodiment, such as device 210; a tubular member 508 to position within a passageway defined by the body of a cabinet according to an embodiment; and instructions for use 510.

While kit 500 is illustrated as including a system 502 for remotely operating a switch, a second device 504 for remotely operating a switch, and a third device 506 for remotely operating a switch, a kit can include any suitable number of devices and/or systems for remotely operating a switch. Example number of devices and/or systems for remotely operating a switch considered suitable to include in a kit include one, at least one, two, a plurality, three, four, five, and any other number considered suitable for a particular embodiment. For example, a kit can omit the inclusion of additional devices for remotely operating a switch and only include a system for remotely operating a switch, or a plurality of systems for remotely operating a switch. Alternatively, a kit can omit the inclusion of a system for remotely operating a switch and only include one or more devices for remotely operating a switch. Optionally, the tubular member 508 to position within a passageway defined by the body of a cabinet and/or the instructions for use 510 can be omitted from kit 500.

Any device for remotely operating a switch that is included in a kit can optionally include one or more, or omit the inclusion, of a plate, a connecting member, a first fastener, a second fastener, a first attachment member, a second attachment member, and/or variations of these components. Any system for remotely operating a switch that is included in a kit can optionally include one or more, or omit the inclusion, of an exterior housing, an elastic member, a first wire member, a second wire member, a first indicator, a second indicator, a pulling member, and/or variations of these components. Optionally, a kit can include, or consist of, a switch that has a handle that comprises one of the devices for remotely operating a switch, as described herein.

Methods of retrofitting a handle of a switch with a device for remotely operating a switch, methods of attaching a system for remotely operating a switch to the handle of a switch and a cabinet, and methods of remotely operating a switch to perform work are described herein. While the methods described herein are shown an described as series of acts, it is to be understood and appreciated that the methods are not limited by the order of acts described and illustrated, as some acts may in accordance with these methods, be omitted, be repeated, or occur in different orders and/or concurrently with other acts described herein. While some steps, optional steps, and/or alternative steps are exemplified by remotely operating a switch that is in communication with a transformer, the methods, steps, optional steps, and/or alternative steps described herein can be used to remotely operate any switch in communication with any device, component, or system. Skilled artisans will be able to select a suitable structure on which to perform the methods, steps, optional steps, and/or alternative steps described herein based on various considerations, such as the type of switch intended to be operated.

Figure 12:
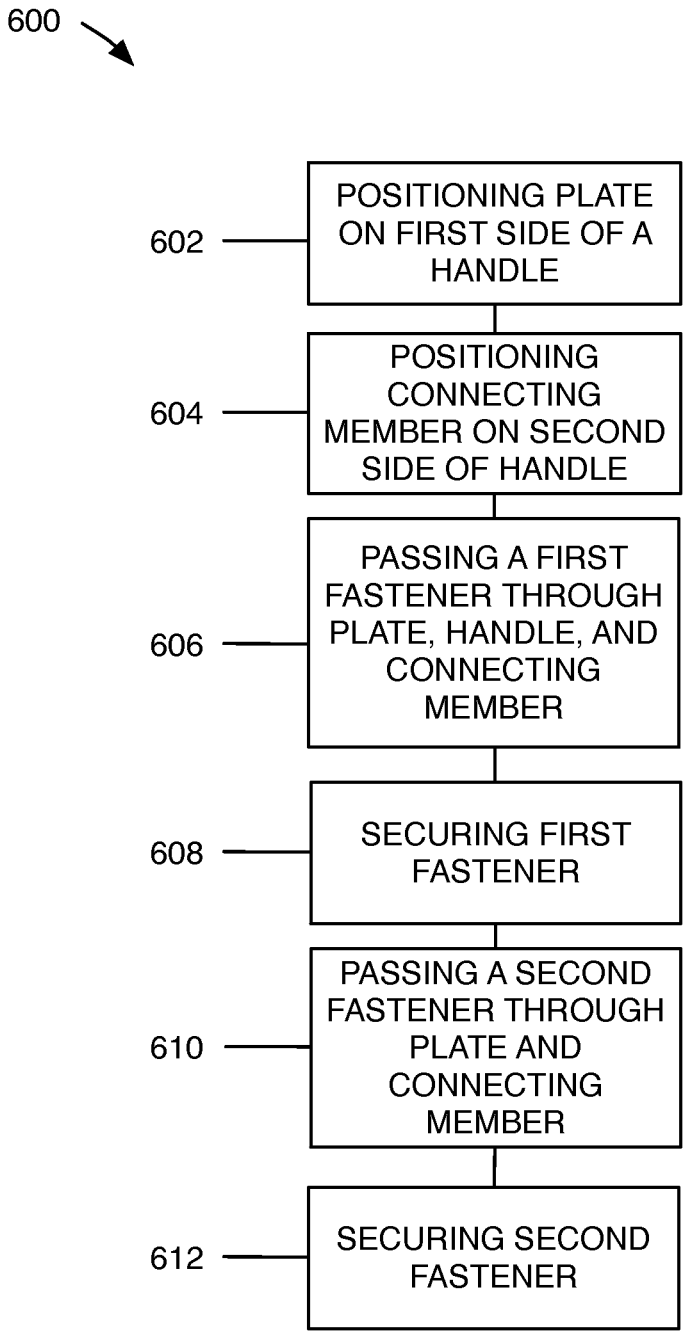
FIG. 12 is a schematic illustration of an example method of retrofitting a handle of a switch with a device for remotely operating a switch.

FIG. 12 is a schematic illustration of an example method 600 of retrofitting a handle of a switch with a device for remotely operating a switch.

A step 602 comprises positioning the plate on a first side of a handle of a switch. Another step 604 comprises positioning the connecting member on a second side of the handle of the switch. The second side of the handle is opposably facing the first side of the handle. Another step 606 comprises passing a first fastener through the plate, the handle of switch, and the connecting member. Another step 608 comprises securing the first fastener to the plate and the connecting member. Another step 610 comprises passing a second fastener through the plate and the connecting member. Another step 612 comprises securing the second fastener to the plate and connecting member.

Method 600 can be accomplished using any suitable device for remotely operating a switch. Example devices for remotely operating a switch considered suitable to attach to a handle of a switch include device 10 for remotely operating a switch, device 110 for remotely operating a switch, device 210 for remotely operating a switch, variations of the devices described herein, and any other device considered suitable for a particular embodiment. An optional step that can be included in method 600 comprises obtaining a device for remotely operating a switch. An example device for remotely operating a switch that can be used to accomplish the methods, steps, optional steps, and/or alternative steps described herein is device 10 and is illustrated and described with respect to FIGS. 1 and 2. The device 10 comprises a plate 12, a connecting member 14, a first fastener 16, a second fastener 18, a first attachment member 20, and a second attachment member 22.

Step 602 can be accomplished by positioning the second side 32 of the plate 12 on a first side of the handle such that it contacts the handle. In embodiments in which method 600 is accomplished using device 110 or device 210, step 602 can be accomplished by positioning the second side of the projection 142 on a first side of the handle such that it contacts the handle. Optionally, step 602 can be accomplished such that a plate contacts the handle through another component, such as a rubber fitting positioned between the plate and the handle.

Step 604 can be accomplished by positioning the connecting member 14 on a second side of the handle such that is contacts the second side of the handle. Optionally, step 604 can be accomplished such that a connecting member contacts the handle through another component, such as a rubber fitting positioned between the connecting member and the handle. Alternatively, step 604 can be omitted from method 600 such that a plate is attached to a handle switch without a connecting member.

Step 606 can be accomplished by positioning a first bolt 68 such that it is coaxial with the third passageway 50 defined by the plate 12, the second passageway 66 defined by the connecting member 14, and a passageway defined by the handle of the switch and applying a force on the first bolt 68 along the axis of the third passageway 50 until the first bolt 68 is passed through the third passageway 50, the second passageway 66, and the passageway defined by the switch. In embodiments in which method 600 is accomplished using device 110 or device 210, step 606 can be accomplished by positioning a first bolt such that it is coaxial with the fifth passageway defined by the plate and applying a force on the first bolt along the axis of the fifth passageway until the first bolt is passed through the fifth passageway, the second passageway defined by the connecting member, and the passageway defined by the switch. In embodiments in which a connecting member has been omitted from the device for remotely operating a switch, step 606 can be accomplished by positioning a bolt such that it is coaxial with a passageway defined by the plate and a passageway defined by the handle of the switch and applying a force on the bolt along the axis of the passageway defined by the plate until the bolt is passed through the passageway defined by the plate and the passageway defined by the switch.

An optional step comprises passing the first bolt used to accomplish step 606 through the passageway defined by a washer prior to completing step 606. This optional step can be accomplished by applying a force on the first bolt along the axis of a passageway defined by the washer until the first bolt is passed through the passageway defined by the washer.

Step 608 can be accomplished by contacting a nut 70 with the first bolt 68 and applying a rotational force on the nut 70 while maintaining the position of the first bolt 68 such that the internal threads 78 of the nut 70 mate with the external threads 74 of the first bolt 68. As described herein, a fastener can comprise any suitable device or component capable of releasably attaching a plate and/or connecting member to the handle of a switch, such as a wingnut. Therefore, steps 606 and 608 can be accomplished using alternative components or steps. For example, in embodiments in which one or more of the passageways defined by a plate and/or connecting member define internal threads, step 608 can alternatively be accomplished by applying a rotational force on the first bolt such that the internal threads defined by the plate and/or connecting member mate with the external threads of the first bolt.

An optional step comprises passing the first bolt used to accomplish step 606 through the passageway defined by a washer prior to completing step 608. This optional step can be accomplished by applying a force on the washer along the axis of the first bolt until the bolt is passed through the passageway defined by the washer.

Step 610 can be accomplished by positioning a second bolt 68 such that it is coaxial with the second passageway 48 defined by the plate 12 and the first passageway 64 of the connecting member 14 and applying a force on the second bolt 68 along the axis of the second passageway 48 until the second bolt 68 is passed through the second passageway 48 of the plate 12 and the first passageway 64 of the connecting member 14. In embodiments in which method 600 is accomplished using device 110 or device 210, step 610 can be accomplished by positioning a second bolt such that it is coaxial with the fourth passageway defined by the plate and applying a force on the second bolt along the axis of the fourth passageway until the second bolt is passed through the fourth passageway defined by the plate and the first passageway of the connecting member.

An optional step comprises passing the second bolt used to accomplish step 610 through the passageway defined by a washer prior to completing step 610. This optional step can be accomplished by applying a force on the second bolt along the axis of a passageway defined by the washer until the second bolt is passed through the passageway defined by the washer.

Step 612 can be accomplished by contacting a nut 70 with the second bolt 68 and applying a rotational force on the nut 70 while maintaining the position of the second bolt 68 such that the internal threads 78 of the nut 70 mate with the external threads 74 of the second bolt 68. As described herein, a fastener can comprise any suitable device or component capable of releasably attaching a plate and/or connecting member to the handle of a switch. Therefore, steps 610 and 612 can be accomplished using alternative components or steps. For example, in embodiments in which one or more of the passageways defined by a plate and/or connecting member define internal threads, step 612 can alternatively be accomplished by applying a rotational force on the second bolt such that the internal threads defined by the plate and/or connecting member mate with the external threads of the second bolt.

Depending on whether the device for remotely operating a switch is preassembled (e.g., first attachment member and/or second attachment member are pre-attached to plate), an optional step comprises passing a first attachment member through the plate. This optional step can be accomplished by positioning a first eye bolt such that it is coaxial with the first passageway defined by the plate and applying a force on the first eye bolt along the axis of the first passageway until a portion of the first eye bolt is passed through the first passageway. Another optional step comprises securing the first attachment member to the plate. This optional step can be accomplished by contacting a nut with the first attachment member and applying a rotational force on the nut while maintaining the position of the first attachment member such that the internal threads of the nut mate with the external threads of the first attachment member.

Another optional step comprises passing a second attachment member through the plate. This optional step can be accomplished by positioning a second eye bolt such that it is coaxial with the fourth passageway defined by the plate and applying a force on the second eye bolt along the axis of the fourth passageway until a portion of the second eye bolt is passed through the fourth passageway. In embodiments in which method 600 is accomplished using device 110 or device 210, the optional step of passing a second attachment member through the plate can be accomplished by positioning a second bolt such that it is coaxial with the third passageway defined by the plate and applying a force on the second bolt along the axis of the third passageway until the second bolt is passed through the third passageway. Another optional step comprises securing the second attachment member to the plate. This optional step can be accomplished by contacting a nut with the second attachment member and applying a rotational force on the nut while maintaining the position of the second attachment member such that the internal threads of the nut mate with the external threads of the second attachment member.

The steps, optional steps, and alternative steps described with respect to method 600 can completed to attach a device for remotely operating a switch to any suitable switch that has a handle and is capable of moving between a first position and a second position. Examples of switches considered suitable to attach a device for remotely operating a switch include electrical switches, loadbreak switches, loadbreak switches in communication with a transformer, loadbreak switches in communication with a switchgear, mechanical switches, and any other switch considered suitable for a particular embodiment.

Figure 13:
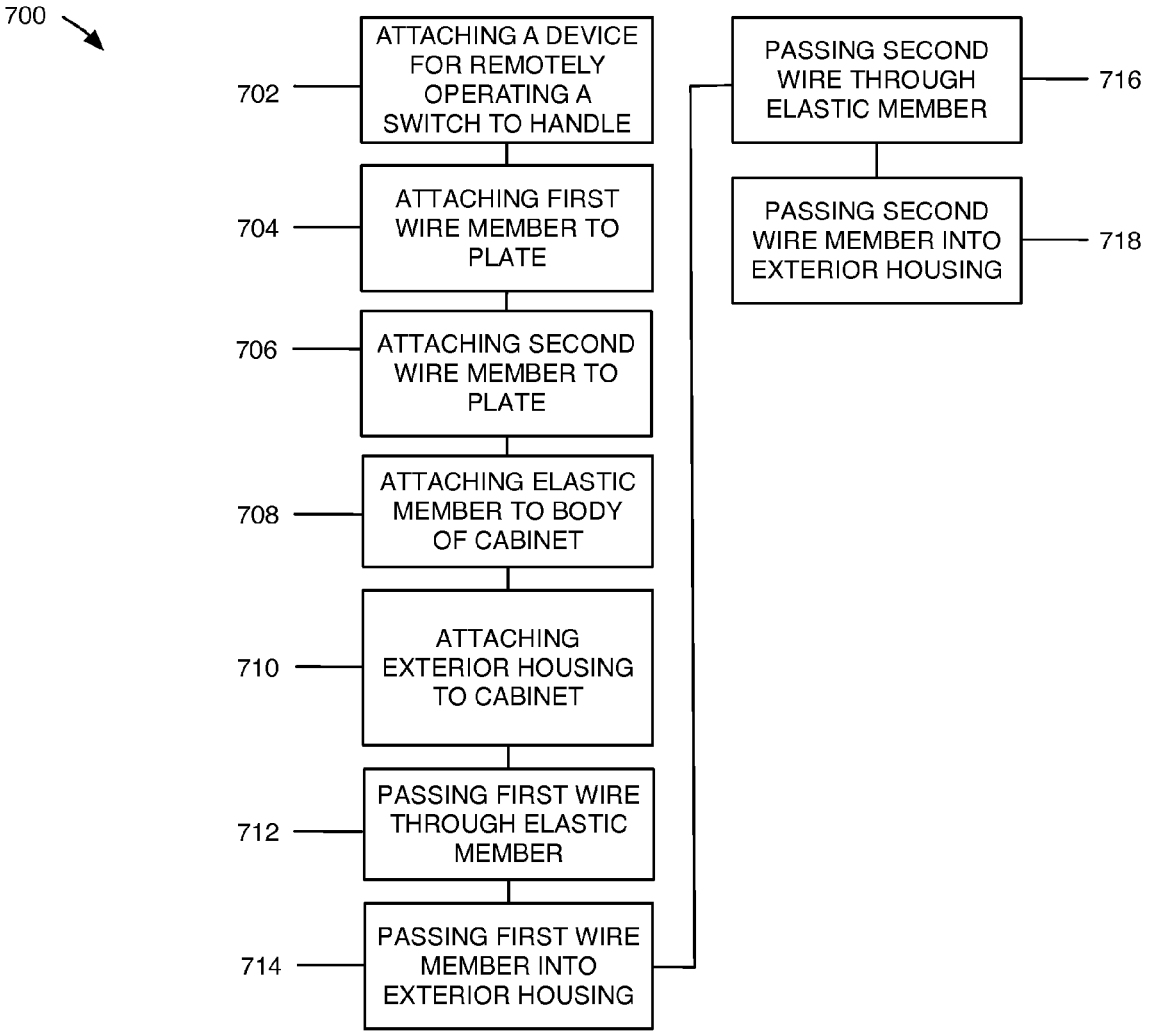
FIG. 13 is a schematic illustration of an example method of attaching a system for remotely operating a switch to the handle of a switch and a cabinet.

FIG. 13 is a schematic illustration of an example method 700 of attaching a system for remotely operating a switch to a handle of a switch and a cabinet. The cabinet houses a transformer, the switch, and the system for remotely operating a switch. The switch is in communication with the transformer.

A step 702 comprises attaching a device for remotely operating a switch to a handle of a switch. Another step 704 comprises attaching a first wire member to the plate. Another step 706 comprises attaching a second wire member to the plate. Another step 708 comprises attaching an elastic member to the body of the cabinet. Another step 710 comprises attaching the exterior housing to the body of the cabinet such that it is in communication with a passageway defined by the body. Another step 712 comprises passing the first wire member through the passageway defined by the elastic member. Another step 714 comprises passing the first wire member through the passageway defined by the housing of the cabinet and into exterior housing. Another step 716 comprises passing the second wire member through the passageway defined by the elastic member. Another step 718 comprises passing the second wire member through the passageway defined by the housing of the cabinet and into exterior housing.

Method 700 can be accomplished using any suitable system for remotely operating a switch. Example systems for remotely operating a switch considered suitable to attach to a handle of a switch and to a cabinet include system 310, variations of the systems described herein, and any other system considered suitable for a particular embodiment. An optional step that can be included in method 700 comprises obtaining a system for remotely operating a switch. An example system for remotely operating a switch that can be used to accomplish the methods, steps, optional steps, and/or alternative steps described herein is system 310 and is illustrated and described with respect to FIGS. 5, 6, 7, 8, and 9. The system 310 comprises a device 10 for remotely operating a switch, as shown in FIGS. 1 and 2, an exterior housing 316, an elastic member 318, a first wire member 320, a second wire member 322, a first indicator 324, a second indicator 326, and a pulling member 328.

While method 700 has been described as being accomplished with an example system 310 for remotely operating a switch that includes device 10, a system for remotely operating a switch can include any suitable device for remotely operating a switch. Example devices for remotely operating a switch considered suitable to include in a system for remotely operating a switch include device 10 for remotely operating a switch, device 110 for remotely operating a switch, device 210 for remotely operating a switch, variations of the devices described herein, and any other device considered suitable for a particular embodiment. An optional step that can be included in method 700 comprises obtaining a device for remotely operating a switch.

Method 700 can be accomplished by attaching a system for remotely operating a switch to any suitable cabinet that houses any suitable device and switch. Example cabinets considered suitable to attach a system for remotely operating a switch include cabinets that house a switchgear, cabinets that house a transformer, cabinets that house a loadbreak switch, and any other cabinet considered suitable for a particular embodiment. An example cabinet considered suitable to attach a system for remotely operating a switch is cabinet 312 and is illustrated and described with respect to FIGS. 5, 6, 7, 8, and 9. The cabinet 312 comprises a body 330, a first door 332, and a second door 334. The body 330, the first door 332, and the second door 334 cooperatively define a chamber 336 that houses a switch 314. The body 330 defines a passageway 338 that provides access between the chamber 336 and an environment exterior to the body 330.

Step 702 can be accomplished utilizing one or more of the steps, optional steps, and/or alternative steps described above with respect to method 600. Optionally, step 702 can be omitted from method 600 in embodiments in which a device for remotely operating a switch comprises the handle of the switch housed by the cabinet.

Step 704 can be accomplished using any suitable structure or method of attachment. For example, step 704 can be accomplished by directly attaching the first wire member to the plate and/or passing a first portion of the first wire member through the fourth passageway defined by the plate and attaching the first portion of the first wire member to a second portion of the first wire member 320. In embodiments in which the device for remotely operating a switch that has been attached to the handle comprises device 110 or device 210, step 704 can be accomplished by passing a first portion of the first wire member through the third passageway defined by the plate and attaching the first portion of the first wire member to a second portion of the first wire member. In embodiments in which the device for remotely operating a switch includes a second attachment member, step 704 can be accomplished by passing a first portion of the first wire member through the passageway defined by the eye bolt and attaching the first portion of the first wire member to a second portion of the first wire member.

Step 706 can be accomplished using any suitable structure or method of attachment. For example, step 706 can be accomplished by directly attaching the second wire member to the plate and/or passing a first portion of the second wire member through the first passageway defined by the plate and attaching the first portion of the first wire member to a second portion of the first wire member. In embodiments in which the device for remotely operating a switch includes a first attachment member, step 706 can be accomplished by passing a first portion of the second wire member through the passageway defined by the eye bolt and attaching the first portion of the second wire member to a second portion of the second wire member.

Step 708 can be accomplished by contacting the elastic member 318 with an interior surface of the cabinet 312 and passing a screw through a portion of the elastic member 318 and into the body 330 of the cabinet 313. While a screw has been described as attaching the elastic member to the body of the cabinet, any suitable structure or method of attachment can be used to attach an elastic member to a cabinet. Example structures or methods of attachment considered suitable to attach an elastic member to a cabinet include threaded members, such as bolts, screws, adhesives, welding, fusing, and any other structure or method of attachment considered suitable for a particular embodiment. Optionally, step 708 can be omitted from method 700 (e.g., in embodiments in which an elastic member is omitted from a system for remotely operating a switch).

Step 710 can be accomplished by contacting the exterior housing 316 with an exterior surface of the cabinet 312 and passing a screw through the body 344 of the exterior housing 316 and into the body 330 of the cabinet 312. The exterior housing 316 is positioned such that the chamber 348 of the exterior housing 316 is in communication with the passageway 338 defined by the body 330 of the housing 312. While a screw has been described as attaching the exterior housing 316 to the cabinet 312, any suitable structure or method of attachment can be used to attach an exterior housing to a cabinet. Example structures and methods of attachment considered suitable to attach an exterior housing to a cabinet include threaded members, such as bolts, screws, nuts, welding, fusing, forming the exterior housing such that it an integrated component of the cabinet, and any other structure or method of attachment considered suitable for a particular embodiment. Optionally, step 710 can be omitted from method 700 (e.g., in embodiments in which an exterior housing is omitted from a system for remotely operating a switch).

In embodiments in which the cabinet does not define a passageway that provides access between the chamber defined by the housing and an exterior environment, an optional step comprises creating a passageway through the body of the housing to provide access between the chamber defined by the housing and an exterior environment. This optional step can be accomplished using any suitable structure or method of creating a passageway through a cabinet. Examples of suitable structures and methods of creating a passageway in the body of a cabinet include drills, punches, cutting tools, snips, using a cutting torch, and any other structure or method considered suitable for a particular embodiment.

An optional step comprises sealing the exterior housing to the cabinet. This step can be accomplished by applying a sealer (e.g., caulk) along the seam between the exterior housing 316 and the cabinet 312. While a sealer has been described as sealing the exterior housing 316 to the cabinet 312, any suitable structure or method of providing a sealing attachment between an exterior housing and a cabinet can be used. Example structures or methods of sealing an exterior housing to a cabinet considered suitable include positioning a gasket (e.g., rubber) between an exterior housing and a cabinet prior to attachment of the exterior housing to the cabinet, welding, fusing, applying a sealer, and any other structure or method of attachment considered suitable for a particular embodiment.

Step 712 can be accomplished by applying a force on the second end 356 of the first wire member 320 on an axis that extends through the passageway 350 defined by the elastic member 318 until the first wire member 320 passes through the passageway 350 defined by the elastic member 318. Optionally, step 712 can be omitted from method 700 in embodiments in which an elastic member is not attached to a cabinet.

Step 714 can be accomplished by applying a force on the second end 356 of the first wire member 320 on an axis that extends through the passageway 338 defined by the body 330 of the cabinet 312 until the first wire member 320 passes through the passageway 338 and into the exterior housing 316. In embodiments in which an exterior housing is not attached to a cabinet, an alternative step comprises applying a force on the second end of the first wire member on an axis that extends through the passageway defined by the body of the cabinet until the first wire member passes through the passageway defined by the body of the cabinet and into an environment exterior to the chamber defined by the cabinet.

Step 716 can be accomplished by applying a force on the second end 362 of the second wire member 322 on an axis that extends through the passageway 350 defined by the elastic member 318 until the second wire member 322 passes through the passageway 350 defined by the elastic member 318. Optionally, step 716 can be omitted from method 700 in embodiments in which an elastic member is not attached to a cabinet.

Step 718 can be accomplished by applying a force on the second end 362 of the second wire member 322 on an axis that extends through the passageway 338 defined by the body 330 of the cabinet 312 until the second wire member 322 passes through the passageway 338 and into the exterior housing 316. In embodiments in which an exterior housing is not attached to a cabinet, an alternative step comprises applying a force on the second end of the second wire member on an axis that extends through the passageway defined by the body of the cabinet until the second wire member passes through the passageway defined by the body of the cabinet and into an environment exterior to the chamber defined by the cabinet.

An optional step comprises attaching a first indicator to the first wire member. This optional step can be accomplished, for example, by passing a first portion of the first wire member through a passageway defined by the first indicator and attaching the first portion of the first wire member to a second portion of the first wire member.

Another optional step comprises attaching a second indicator to the second wire member. This optional step can be accomplished, for example, by passing a first portion of the second wire member through a passageway defined by the second indicator and attaching the first portion of the second wire member to a second portion of the second wire member.

Another optional step comprises attaching a pulling member to a first wire member and/or a second wire member. This optional step can be accomplished, for example, by attaching the hook of a pulling member to the second end of a first wire member and/or second wire member.

Figure 14:
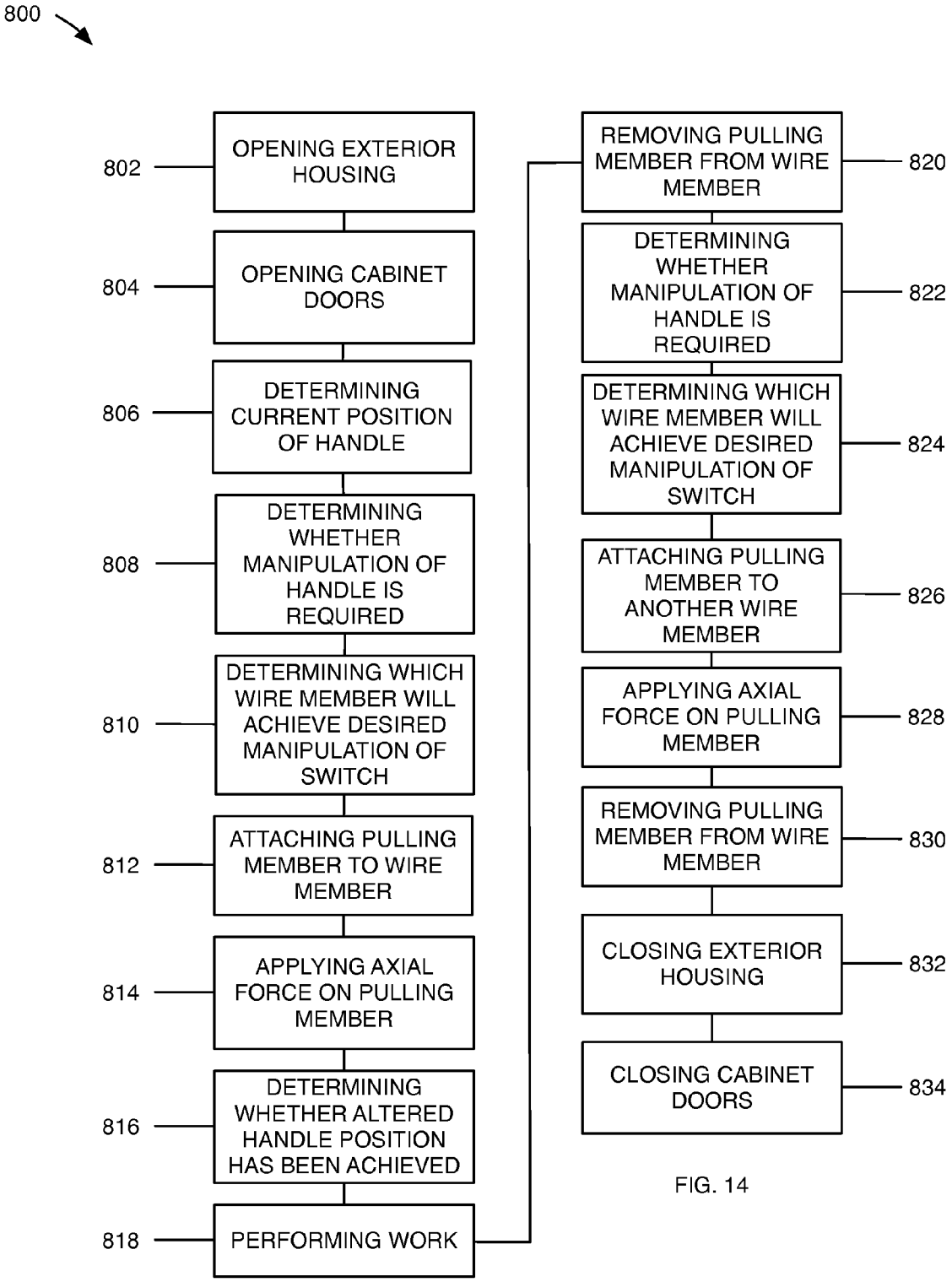
FIG. 14 is a schematic illustration of an example method of remotely operating a switch to perform work.

FIG. 14 is a schematic illustration of an example method 800 of remotely operating a switch to perform work.

A step 802 comprises opening the exterior housing that contains the second end of the first wire member and the second end of the second wire member. Another step 804 comprises opening the doors to the cabinet. Another step 806 comprises determining the current position of a handle of a switch. Another step 808 comprises determining whether manipulation of the handle is required. If manipulation of the handle is required, another step 810 comprises determining which wire member will achieve the desired manipulation of the switch. Another step 812 comprises attaching the pulling member to the second end of the wire member that will achieve the desired manipulation of the switch. Another step 814 comprises applying an axial force away from the handle on the pulling member until the handle moves from its original position to an altered position. Another step 816 comprises determining whether the altered position of the handle has been achieved. Another step 818 comprises performing work. Another step 820 comprises removing the pulling member from the second end of the wire member to which the pulling member is attached. Another step 822 comprises determining whether manipulation of the handle is required. If manipulation of the handle is required, another step 824 comprises determining which wire member will achieve the desired manipulation of the switch. Another step 826 comprises attaching the pulling member to the second end of the wire member that will achieve the desired manipulation of the switch. Another step 828 comprises applying an axial force away from the handle until on the pulling member until the handle moves from its original position to an altered position. Another step 830 comprises removing the pulling member from the wire member to which it is attached. Another step 832 comprises closing the exterior housing. Another step 834 comprises closing the doors to the cabinet.

Method 800 can be accomplished using any suitable system for remotely operating a switch. Example systems considered suitable for remotely operating a switch include system 310, variations of the system described herein, and any other system considered suitable for a particular embodiment. An optional step that can be included in method 800 comprises obtaining a system for remotely operating a switch. An example system for remotely operating a switch that can be used to accomplish the methods, steps, optional steps, and/or alternative steps described herein is system 310 that is described and illustrated with respect to FIGS. 5, 6, 7, 8, and 9. The system 310 comprises a device 10 for remotely operating a switch, as shown in FIGS. 1 and 2, an exterior housing 316, an elastic member 318, a first wire member 320, a second wire member 322, a first indicator 324, a second indicator 326, and a pulling member 328.

Method 800 can be accomplished using a system for remotely operating a switch attached to any suitable cabinet that houses any suitable device and switch. Example cabinets considered suitable to attach a system for remotely operating a switch include cabinets that house a switchgear, cabinets that house a transformer, cabinets that house a loadbreak switch, and any other cabinet considered suitable for a particular embodiment. An example cabinet considered suitable to attach a system for remotely operating a switch is cabinet 312 that is described and illustrated with respect to FIGS. 5, 6, 7, 8, and 9. The cabinet 312 comprises a body 330, a first door 332, and a second door 334. The body 330, the first door 332, and the second door 334 cooperatively define a chamber 336 that houses the switch 314. The body 330 defines a passageway 338 that provides access between the chamber 336 and an environment exterior to the body 330.

While method 800 has been described as being accomplished with an example system 310 for remotely operating a switch that includes device 10, a system for remotely operating a switch can include any suitable device for remotely operating a switch. Example devices for remotely operating a switch considered suitable to include in a system for remotely operating a switch include device 10 for remotely operating a switch, device 110 for remotely operating a switch, device 210 for remotely operating a switch, variations of the devices described herein, and any other device considered suitable for a particular embodiment. An optional step that can be included in method 800 comprises obtaining a device for remotely operating a switch.

Step 802 can be accomplished by applying a force on the cover 346 in a direction away from the body 344 of the exterior housing 316 until the chamber 348 is accessible. An optional step comprises removing a locking mechanism that is releasably attached to the exterior housing 316.

Step 804 can be accomplished by applying a force to each of the doors 332, 334 in a direction away from the body 330 of the cabinet 312 until the chamber 336 is accessible. An optional step comprises removing a locking mechanism that is releasably attached to the doors 332, 334 of the cabinet 312.

Step 806 can be accomplished by visually identifying the handle 314 of the switch and determining whether the handle 340 is in the first position or second position.

Step 808 can be accomplished based on the procedure intended to be completed on a device, component, or system that is in communication with the switch 314. If the handle 340 is in the first position such that the switch 314 is in the closed state and it is desired to conduct maintenance on a device, component, or system that is positioned downstream from the switch 314 without a current being provided to the device, component, or system, manipulation of the switch 314 is required. Alternatively, if the handle 340 is in the first position such that the switch 314 is in the closed state and it is desired to conduct maintenance on a device, component, or system that is positioned downstream from the switch 314 with a current being provided to the device, component, or system, manipulation of the switch 314 is not required and steps 810, 812, 814, 816, 818, 820, 822, 824, 826, 828, and/or 830 can be omitted from method 800.

If the handle 340 is in the second position such that the switch 314 is in the open state and it is desired to conduct maintenance on a device, component, or system that is positioned downstream from the switch 314 with a current being provided to the device, component, or system, manipulation of the switch 314 is required. Alternatively, if the handle 340 is in the second position such that the switch 314 is in the open state and it is desired to conduct maintenance on a device, component or system that is positioned downstream from the switch 314 without a current being provided to the device, component, or system, manipulation of the switch 314 is not required and steps 810, 812, 814, 816, 818, 820, 822, 824, 826, 828, and/or 830 can be omitted from method 800.

Figure 16:
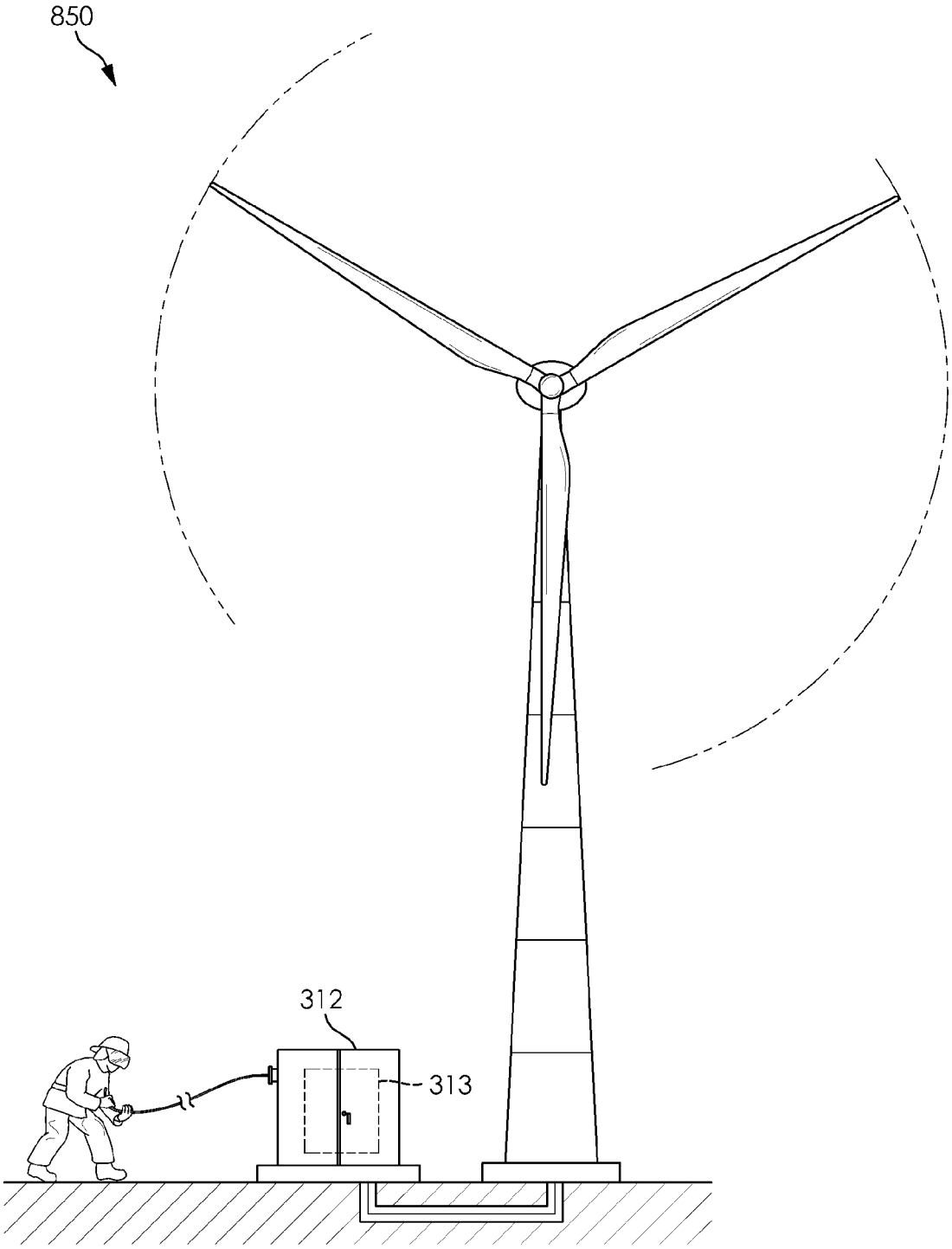
FIG. 16 is an elevation view of an operator remotely operating a loadbreak switch to service a wind turbine using an example embodiment of a system for remotely operating a switch.

Optionally, to completely remove the current being provided to the switch 314, the device to which the switch 314 is attached (e.g., transformer), or the devices, components, or systems positioned downstream from the switch 314 that are in communication with the switch 314, the devices, components, or systems positioned upstream from the switch 314 that are in communication with the switch 314 can be switched from an on state to an off state, if currently in an on state. For example, FIG. 16 illustrates a wind turbine 850 in communication with a transformer 313 housed within cabinet 312. FIG. 16 illustrates wind turbine 850 in an on state. An optional step comprises switching the wind turbine 850 from an on state to an off state. Alternatively, to apply a current to the switch 314, the device to which the switch is attached (e.g., transformer), or the devices, components, or systems positioned downstream from the switch 314 that are in communication with the switch 314, the devices, components, or systems positioned upstream from the switch 314 that are in communication with the switch 314 can be switched from an off state to an on state, if currently in an off state. An optional step comprises switching the wind turbine 850 from an off state to an on state.

Step 810 can be accomplished by visually identifying the wire member that, when moved to from its first position to its second position or from its second position to its first position, will achieve the desired manipulation of the switch 314. For example, if it is desired to move the switch 314 from a closed state to an open state, the first wire member 320 will achieve the desired manipulation of the switch 314. Alternatively, if it is desired to move the switch 314 from an open state to a closed state, the second wire member 322 will achieve the desired manipulation of the switch.

Step 812 can be accomplished by attaching the hook of a pulling member to the second end of the wire member that will achieve the desired manipulation of the switch. For example, if it is desired to move the switch 314 from a closed state to an open state, step 812 can be accomplished by attaching the hook 376 of a pulling member 328 to the second end 356 of the first wire member 320. Alternatively, if it is desired to move the switch 314 from an open state to a closed state, step 812 can be accomplished by attaching the hook 376 of a pulling member 328 to the second end 362 of the second wire member 322. Optionally, step 812 can be omitted from method 800 in embodiments in which a pulling member is pre-attached to the first wire member and/or second wire member and/or in embodiments in which the first wire member and/or second wire member act as the pulling member.

Step 814 can be accomplished by applying an axial force on the pulling member 328 away from the handle 340 of the switch 314 until the handle 340 moves from its original position to an altered position. For example, if it is desired to move the switch 314 from a closed state to an open state, step 814 can be accomplished by applying an axial force on the pulling member 328 away from the handle 340 of the switch 314 until the first wire member 320 moves the handle 340 from the first position to the second position. Alternatively, if it is desired to move the switch 314 from an open state to a closed state, step 814 can be accomplished by applying an axial force on the pulling member 328 away from the handle 340 of the switch 314 until the second wire member 322 moves the handle 340 from the second position to the first position. Alternatively, in embodiments in which the wire members act as the pulling member, step 814 can comprise applying an axial force on a wire member to achieve the desired manipulation of the switch.

Step 816 can be accomplished by visually identifying the handle 340 of the switch 314 and determining whether the handle 340 is in the first position or second position.

Step 818 can be accomplished based on the procedure intended to be completed on a switch and/or a device, component, or system that is in communication with the switch. For example, step 818 can comprise performing work on the switch 314, the transformer 313 housed within the cabinet 312, and/or performing work on the wind turbine 850.

Step 820 can be accomplished by removing the hook of the pulling member from the second end of the wire member to which it is currently attached. For example, if the pulling member 328 is attached to the second end 356 of the first wire member 320, step 820 can be accomplished by removing the pulling member 328 from the second end 356 of the first wire member 320. Alternatively, if the pulling member 328 is attached to the second end 362 of the second wire member 322, step 820 can be accomplished by removing the pulling member 328 from the second end 362 of the second wire member 322. Optionally, step 820 can be omitted from method 800 is embodiments in which a pulling member is attached to each of the first wire member and the second wire member and/or in embodiments in which the first wire member and/or second wire member act as the pulling member.

Step 822 can be accomplished based on the state in which it is desired to position the switch 314 before completing step 834 (e.g., closing the doors of the cabinet). If the handle 340 is in the first position such that the switch 314 is in the closed state and it is desired to position the handle 340 in the first position before completing step 834, no manipulation of the switch is required and steps 824, 826, 828, and/or 830 can be omitted from method 800. Alternatively, if the handle 340 is in the first position such that the switch 314 is in the closed state and it is desired to position the handle 340 in the second position before completing step 834, manipulation of the switch is required. If the handle 340 is in the second position such that the switch 314 is in the open state and it is desired to position the handle 340 in the second position before completing step 834, no manipulation of the switch is required and steps 824, 826, 828, and/or 830 can be omitted from method 800. Alternatively, if the handle 340 is in the second position such that the switch 314 is in the open state and it is desired to position the handle 340 in the first position before completing step 834, manipulation of the switch 314 is required.

Step 824 can be accomplished by visually identifying the wire member that, when moved to from its first position to its second position or from its second position to its first position, will achieve the desired manipulation of the switch. For example, if it is desired to move the switch 314 from an open state to a closed state, the second wire member 322 will achieve the desired manipulation of the switch 314. Alternatively, if it is desired to move the switch 314 from a closed state to an open state, the first wire member 320 will achieve the desired manipulation of the switch 314.

Step 826 can be accomplished by attaching the hook of a pulling member to the second end of the wire member that will achieve the desired manipulation of the switch. For example, if it is desired to move the switch 314 from a closed state to an open state, step 826 can be accomplished by attaching the hook 376 of a pulling member 328 to the second end 356 of the first wire member 320. Alternatively, if it is desired to move the switch 314 from an open state to a closed state, step 826 can be accomplished by attaching the hook 376 of a pulling member 328 to the second end 362 of the second wire member 322. Optionally, step 826 can be omitted from method 800 in embodiments in which a pulling member is pre-attached to the first wire member and/or second wire member and/or in embodiments in which the first wire member and/or second wire member act as the pulling member.

Step 828 can be accomplished by applying an axial force on the pulling member 328 away from the handle 340 of the switch 314 until the handle 340 moves from its original position to an altered position. For example, if it is desired to move the switch 314 from a closed state to an open state, step 828 can be accomplished by applying an axial force on the pulling member 328 away from the handle 340 of the switch 314 until the first wire member 320 moves the handle 340 from the first position to the second position. Alternatively, if it is desired to move the switch 314 from an open state to a closed state, step 828 can be accomplished by applying an axial force on the pulling member 328 away from the handle 340 of the switch 314 until the second wire member 322 moves the handle 340 from the second position to the first position.

Step 830 can be accomplished by removing the hook of a pulling member from the second end of the wire member to which it is attached. For example, if the pulling member 328 is attached to the second end 356 of the first wire member 320, step 830 can be accomplished by removing the pulling member 328 from the second end 356 of the first wire member 320. Alternatively, if the pulling member 328 is attached to the second end 362 of the second wire member 322, step 830 can be accomplished by removing the pulling member 328 from the second end 362 of the second wire member 322. Optionally, step 830 can be omitted from method 800 in embodiments in which the first wire member and/or second wire member act as the pulling member.

Optionally, step 830 can be omitted from method 800 is embodiments in which a pulling member is attached to the first wire member and/or the second wire member and it is desired to maintain attachment of the pulling members subsequent to use. An optional step comprises positioning the pulling member within the chamber defined by the external housing.

Step 834 can be accomplished by applying a force on the cover 346 in a direction toward the body 344 of the exterior housing 316 until the chamber 348 is inaccessible. An optional step comprises attaching a locking mechanism to the exterior housing 316.

Step 836 can be accomplished by applying a force to each of the doors in a direction toward the body 330 of the cabinet 312 until the chamber 336 is inaccessible. An optional step comprises attaching a locking mechanism to the doors 332, 334 of the cabinet.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A device for remotely operating a switch, the device comprising:

a plate having a first end, a second end, a first end portion, an intermediate portion, a second end portion, and a body defining a first bend, a second bend, a first passageway, a second passageway, a third passageway, and a fourth passageway, the first end portion extending from the first end to the intermediate portion, the intermediate portion extending from the first end portion to the second end portion, the second end portion extending from the intermediate portion to the second end, the first bend defined between the first passageway and the second passageway such that the first end portion extends from the first bend in a first direction, the second bend defined between the third passageway and the fourth passageway such that the second end portion extends from the second bend in a second direction that is substantially opposite the first direction, the first passageway defined on the first end portion, the fourth passageway defined on the second end portion;

a connecting member attached to the plate and having a first end, a second end, and a body defining a first passageway and a second passageway;

a first fastener adapted to provide releasable attachment between the plate, the connecting member, and said switch, the first fastener partially disposed within the second passageway defined by the plate and the first passageway defined by the connecting member; and a second fastener adapted to provide releasable attachment between the plate, the connecting member, and said switch, the second fastener partially disposed within the third passageway defined by the plate and the second passageway defined by the connecting member.

2. The device of claim 1, wherein the first bend is defined at a first angle; and wherein the second bend is defined at a second angle that is the same as the first angle.

3. The device of claim 1, wherein the first bend is defined at a first angle; and wherein the second bend is defined at a second angle that is different than the first angle.

4. The device of claim 1, further comprising a first attachment member partially disposed within the first passageway defined by the plate, the first attachment member defining a passageway extending through the first attachment member; and further comprising a second attachment member partially disposed within the fourth passageway defined by the plate, the second attachment member defining a passageway extending through the second attachment member.

5. The device of claim 4, wherein each of the first attachment member and the second attachment member comprises an eye bolt.

6. The device of claim 1, wherein the plate has a first side and a second side opposably facing the first side; and wherein each of the first passageway, second passageway, third passageway, and fourth passageway extends from the first side to the second side.

7. The device of claim 1, wherein each of the second passageway and third passageway is defined on the intermediate portion.

8. The device of claim 1, wherein the intermediate portion has a length that extends from the first end portion to the second end portion;

wherein the connecting member has a length that extends from the first end of the connecting member to the second end of the connecting member; and wherein the length of the connecting member is equal to the length of the intermediate member.

9. A kit for remotely operating a switch housed within a cabinet, the kit comprising:

a device for remotely operating said switch, the device comprising:

a plate having a first end, a second end, a first end portion, an intermediate portion, a second end portion, and a body defining a first bend, a second bend, a first passageway, a second passageway, a third passageway, and a fourth passageway, the first end portion extending from the first end to the intermediate portion, the intermediate portion extending from the first end portion to the second end portion, the second end portion extending from the intermediate portion to the second end, the first bend defined between the first passageway and the second passageway such that the first end portion extends from the first bend in a first direction, the second bend defined between the third passageway and the fourth passageway such that the second end portion extends from the second bend in a second direction that is substantially opposite the first direction, the first passageway defined on the first end portion, the fourth passageway defined on the second end portion;

a connecting member releasably attachable to the plate and having a first end, a second end, and a body defining a first passageway and a second passageway;

a first fastener adapted to provide releasable attachment between the plate, the connecting member, and said switch, the first fastener sized and configured to be partially disposed within the second passageway defined by the plate and the first passageway defined by the connecting member; and a second fastener adapted to provide releasable attachment between the plate, the connecting member, and said switch, the second fastener sized and configured to be partially disposed within the third passageway defined by the plate and the second passageway defined by the connecting member;

a first wire member adapted to be attached to the plate and moveable between a first position and a second position when attached to the plate;

a second wire member adapted to be attached to the plate and moveable between a first position and a second position when attached to the plate; and a pulling member adapted to be attached to the first wire member or the second wire member.

10. The kit of claim 9, further comprising a first indicator adapted to be attached to the first wire member and comprising one or more indicia corresponding to the state of said switch when the first wire member is attached to the plate and in the second position;

a second indicator adapted to be attached to the second wire member and comprising one or more indicia corresponding to the state of said switch when the second wire member is attached to the plate and in the second position; and an exterior housing adapted to be attached to said cabinet and having a body and a cover, the exterior housing sized and configured to house a portion of the first wire member, the second wire member, the first indicator, and the second indicator.

11. The kit of claim 9, wherein the first wire member has a first end, a second end, and a length extending from the first end of the first wire member to the second end of the first wire member;

wherein the second wire member has a first end, a second end, and a length extending from the first end of the second wire member to the second end of the second wire member; and wherein the length of the first wire member is greater than the length of the second wire member.

12. The kit of claim 9, wherein the first wire member has a first end, a second end, and a length extending from the first end of the first wire member to the second end of the first wire member;

wherein the pulling member has a first end, a second end, and a length extending from the first end of the pulling member to the second end of the pulling member; and wherein the length of the pulling member is greater than the length of the first wire member.

13. The kit of claim 9, wherein the first bend is defined at a first angle; and wherein the second bend is defined at a second angle that is the same as the first angle.

14. The kit of claim 9, wherein the first bend is defined at a first angle; and wherein the second bend is defined at a second angle that is different than the first angle.

15. The kit of claim 9, further comprising a first attachment member adapted to be partially disposed within the first passageway defined by the plate, the first attachment member defining a passageway extending through the first attachment member; and further comprising a second attachment member adapted to be partially disposed within the fourth passageway defined by the plate, the second attachment member defining a passageway extending through the second attachment member.

16. The kit of claim 15, wherein each of the first attachment member and the second attachment member comprises an eye bolt.

17. The kit of claim 9, wherein each of the second passageway and third passageway is defined on the intermediate portion.

18. The kit of claim 9, wherein the intermediate portion has a length that extends from the first end portion to the second end portion;

wherein the connecting member has a length that extends from the first end of the connecting member to the second end of the connecting member; and wherein the length of the connecting member is equal to the length of the intermediate member.

19. A method of retrofitting a handle of a switch with a device for remotely operating a switch, the handle defining a passageway and having a first side and a second side opposably facing the first side, the method comprising the steps of:

obtaining a device for remotely operating a switch, the device comprising:

a plate having a first end, a second end, a first end portion, an intermediate portion, a second end portion, and a body defining a first bend, a second bend, a first passageway, a second passageway, a third passageway, and a fourth passageway, the first end portion extending from the first end to the intermediate portion, the intermediate portion extending from the first end portion to the second end portion, the second end portion extending from the intermediate portion to the second end, the first bend defined between the first passageway and the second passageway such that the first end portion extends from the first bend in a first direction, the second bend defined between the third passageway and the fourth passageway such that the second end portion extends from the second bend in a second direction that is substantially opposite the first direction, the first passageway defined on the first end portion, the fourth passageway defined on the second end portion;

a connecting member attached to the plate and having a first end, a second end, and a body defining a first passageway and a second passageway;

a first fastener adapted to provide releasable attachment between the plate, the connecting member, and said switch; and a second fastener adapted to provide releasable attachment between the plate, the connecting member, and said switch;

positioning the plate on said first side of said handle;

positioning the connecting member on said second side of said handle;

passing the first fastener through the second passageway defined by the plate and the first passageway defined by the connecting member;

securing the first fastener to the plate and the connecting member;

passing the second fastener through the third passageway defined by the plate, said passageway defined by the handle, and the second passageway defined by the connecting member; and securing the second fastener to the plate, said handle, and the connecting member.

20. The method of claim 19, further comprising the step of positioning a first attachment member within the first passageway defined by the plate, the first attachment member defining a passageway extending through the first attachment member; and further comprising the step of positioning a second attachment member within the fourth passageway defined by the plate, the second attachment member defining a passageway extending through the second attachment member.

* * * * *